US008488816B2

(12) United States Patent
Inagaki et al.

(10) Patent No.: US 8,488,816 B2
(45) Date of Patent: Jul. 16, 2013

(54) ELECTRO-ACOUSTIC TRANSDUCER WITH MULTI-FACED DIAPHRAGM ASSEMBLY

(75) Inventors: Kazuyuki Inagaki, Yokohama (JP); Manabu Omoda, Yokohama (JP); Jiro Nakaso, Yokohama (JP)

(73) Assignee: JVC Kenwood Corporation, Yokohama-shi, Kanagawa (JP)

( * ) Notice: Subject to any disclaimer, the term of this patent is extended or adjusted under 35 U.S.C. 154(b) by 276 days.

(21) Appl. No.: 12/898,155

(22) Filed: Oct. 5, 2010

(65) Prior Publication Data

US 2011/0019867 A1 Jan. 27, 2011

Related U.S. Application Data

(62) Division of application No. 11/402,767, filed on Apr. 13, 2006, now Pat. No. 7,835,536.

(30) Foreign Application Priority Data

Apr. 15, 2005 (JP) ..... P2005-118492
Apr. 28, 2005 (JP) ..... P2005-133183
Feb. 22, 2006 (JP) ..... P2006-045927

(51) Int. Cl.
*H04R 25/00* (2006.01)

(52) U.S. Cl.
USPC ..... 381/182; 381/385; 381/386; 381/335; 381/336

(58) Field of Classification Search
USPC ..... 381/182, 385, 386, 336, 335; 181/144
See application file for complete search history.

(56) References Cited

U.S. PATENT DOCUMENTS

| | | | | | |
|---|---|---|---|---|---|
| 4,437,540 | A | * | 3/1984 | Murakami et al. | 181/147 |
| 4,672,057 | A | | 6/1987 | Bargiotti et al. | |
| 4,673,057 | A | * | 6/1987 | Glassco | 181/144 |
| 4,890,689 | A | * | 1/1990 | Smith | 181/144 |
| 5,025,473 | A | * | 6/1991 | Carlsen et al. | 381/387 |
| 5,889,876 | A | * | 3/1999 | Billings | 381/342 |
| 5,889,877 | A | * | 3/1999 | Bunzow | 381/386 |

FOREIGN PATENT DOCUMENTS

| | | | |
|---|---|---|---|
| JP | S56-83196 | U | 7/1981 |
| JP | 57-127397 | A | 8/1982 |
| JP | 09-070092 | A | 3/1997 |
| JP | 09-284886 | A | 10/1997 |
| JP | 2000-078686 | A | 3/2000 |
| JP | 2001-095088 | A | 4/2001 |
| JP | 2005-123893 | A | 5/2005 |

* cited by examiner

*Primary Examiner* — Davetta W Goins
*Assistant Examiner* — Jasmine Pritchard
(74) *Attorney, Agent, or Firm* — Nath, Goldberg & Meyer; Jerald L. Meyer

(57) ABSTRACT

One mode of the present invention provides an electroacoustic transducer composed of a multifaced diaphragm assembly and a multifaced speaker housing assembly that is housed inside the multifaced diaphragm assembly. The multifaced speaker housing is configured by combining the outer peripheral surface of a plurality of individual speaker drive units into a nearly spherical shell. The multifaced diaphragm assembly, which has thereinside the multifaced speaker housing assembly, is configured to have a plurality of regular pentagonal diaphragm segments that are combined together into a nearly spherical shape shell, and a plurality of speaker drive units opposing the diaphragm segments from inside in one-to-one relation. Each speaker drive unit has a bobbin, the one end portion of which is adhered to the center portion of the inner surface of each diaphragm segment.

8 Claims, 28 Drawing Sheets

ELECTRO-ACOUSTIC TRANSDUCER WITH MULTI-FACED DIAPHRAGM ASSEMBLY

This is a Divisional Application of U.S. patent application Ser. No. 11/402,767, filed on Apr. 13, 2006, which claims priority to Japanese Patent Application No.(s): P2005-118492, filed on Apr. 15, 2005, Application No. P2005-133183, filed on Apr. 28, 2005, and Application No P2006-045927, filed on Feb. 22, 2006, the content of each of which is hereby incorporated by reference in its entirety.

BACKGROUND OF THE INVENTION

1. Field of the Invention

The present invention relates to an electroacoustic transducer comprising a multifaced diaphragm assembly that includes a diaphragm obtained by combining a plurality of polygonal diaphragm segments into a nearly spherical shell shape, and a plurality of speaker driving units arranged inside the multifaced diaphragm assembly so that each speaker driving unit opposes the corresponding diaphragm segment.

2. Description of the Related Art

An electroacoustic transducer (speaker) for producing sound from an audio signal is realized in various forms, one of which is for example a point-source omnidirectional speaker system that delivers reproduced sound to human ears as if the sound is radiated from a pulsating sphere (refer to, for example, Japanese Patent Application Laid-open Publication No. 1309-70092).

The aforementioned pulsating sphere is a sound source considered as an ideal form of an omnidirectional speaker. This sound source produces the same sound pressure in all directions as if a balloon vibrated by expanding and shrinking itself, thereby radiating sound completely omnidirectionally. The name of pulsating sphere is given to such a sound source because the sphere vibrates as if pulsating.

FIG. 1 is a perspective view of an example of a related art point-source omnidirectional speaker system. FIG. 2 is a block diagram of the related art point-source omnidirectional speaker system. FIG. 3 is a frequency response of a speaker unit constituting the related art point-source omnidirectional speaker system, in which peaks and dips in the frequency response is representatively shown.

A point-source omnidirectional speaker system 100 shown in FIGS. 1 and 2 is one disclosed in the above publication (Japanese Patent Application Laid-open Publication No. H09-70092), which will be briefly outlined referring thereto.

As shown in FIG. 1, in the related art point-source omnidirectional speaker system 100, a hollow spherical enclosure 101 with rigidity is configured into a polyhedron having a total of 32 faces consisting of 12 pentagonal first faces 101*a* and 20 hexagonal second faces 101*b*. By the way, the enclosure 101 is also called a speaker cabinet or a speaker box.

On each of the first faces 101*a* and the second faces 101*b* of the enclosure 101, there is provided a full-range speaker unit 102 as exemplified in FIG. 1.

In addition to the above example, there is disclosed another example where a low-pitched sound speaker unit 103 is provided on each of the first faces 101*a* of the enclosure 102 and a high-pitched sound speaker unit 104 is provided on each of the second faces 101*b*.

Moreover, FIG. 2 shows that a digital input signal 110 is supplied to the speaker units 102 (or 103 and 104) through a digital signal processor (DSP) 111 accompanying an operation panel 112, a digital-to-analog (D/A) converter 113, an analog attenuator 114, and a power amplifier 115 in this order.

When a speaker assembly in which the full-range speaker units 102 (or the low-pitched sound speaker units 103 and the high-pitched sound speaker units 104) are arranged on the enclosure 101 of a polyhedron having 32 faces (truncated icosahedron) is driven to radiate sound, peaks P and dips D appear in its frequency response as representatively shown in FIG. 3. In order to reduce the peaks P and the dips D, a drive signal that drives each speaker unit 102 (or 103, 104) is processed by filtering in the DSP 111 shown in FIG. 2, the filtering having a compensatory characteristic to the dips D, and then the processed drive signal is converted to an analog signal by the D/A converter 113. Then the analog signal is supplied to the speaker unit 102 (or 103, 104) after passing through the analog attenuator 114 and the power amplifier 115 in this order. This is what is disclosed in the above publication.

By the way, although the related art point-source omnidirectional speaker system 100 mentioned above has the full-range speaker units 102 (or the high-pitched sound speaker units 103 and the low-pitched sound speaker units 104) arranged on the enclosure 101 having a shape of truncated icosahedron, a portion that vibrates to produce sound is apparently limited to a specific diaphragm (not shown) that is integrated to each speaker unit 102 (or 103 and 104).

In such a configuration, there exists no vibratory portion between the neighboring speaker units but a rigid portion that constitutes apart of the enclosure 101, so that synthetic sound produced by mixing of sound from each speaker unit 102 (or 103 and 104) may not emulate sound from a point source.

In addition, while the dips D appearing in the frequency response of the sound produced by each speaker unit 102 (or 103 and 104) is reduced due to a compensatory filtering performed by the DSP 111, as explained with reference to FIG. 3, such filtering can be unnecessitated if the configuration of the speaker unit per se is able to reduce generation of the dips D.

Therefore, there has been awaited an electroacoustic transducer that can provide an omnidirectional point source of sound as a pulsating sphere and reduce the dips appearing in the frequency response of the sound produced by a plurality of speaker units. In addition, there has been desired an electricacoustic transducer that can be productively assembled into a three dimensionally radial shape, even when the transducer has to be assembled in a way that a multifaced diaphragm assembly having a shape of a nearly spherical shell is created so as to include a diaphragm obtained by combining a plurality of polygonal diaphragm segments and then a plurality of speaker drive units are arranged inside the multifaced diaphragm assembly so as to respectively oppose the corresponding diaphragm segment.

SUMMARY OF THE INVENTION

The present invention has been made in view of the above disadvantages. A first aspect of the present invention provides an electroacoustic transducer comprising a multifaced diaphragm assembly which includes a diaphragm formed by combining a plurality of polygonal diaphragm segments and has a nearly spherical shell shape, and a plurality of speaker drive units which include a speaker housing, a bobbin that is supported vibratably by the speaker housing and adhered at one end portion thereof on an inner center portion of each of the diaphragm segments, a voice coil that is attached on the other end portion of the bobbin, a yoke, and a magnet that generates a drive force in the voice coil along with the yoke, the plurality of speaker drive units being arranged inside the multifaced diaphragm assembly so as to oppose respectively the diaphragm segments, wherein the plurality of the speaker housings are combined to form a multifaced speaker housing assembly and wherein the multifaced speaker housing assembly is housed inside the multifaced diaphragm assembly.

A second aspect of the present invention provides an electroacoustic transducer according to the first aspect, wherein the multifaced speaker housing assembly is configured so that each of the speaker housings is combined with each other through concave-convex fitting, which is realized if a projection and a hole are provided in the outer peripheral surface of each speaker housing so that the projection is fitted into the hole between the every neighboring two speaker housings.

A third aspect of the present invention provides an electroacoustic transducer according to the first or the second aspect, further comprising a path allowing air to pass through between the inner and the outer portion of the multifaced speaker housing assembly.

A fourth aspect of the present invention provides an electroacoustic transducer according to the first aspect, wherein the multifaced diaphragm assembly includes as part thereof at least one pedestal having the same outer shape as the diaphragm segment thereby being formed into the nearly spherical shell shape.

A fifth aspect of the present invention provides an electroacoustic transducer according to the fourth aspect; wherein the multifaced speaker housing assembly includes as part thereof at least one supporting plate having the same outer shape as the speaker housing thereby being formed into the nearly spherical shell shape, the supporting plate opposing the pedestal; wherein at least one pipe member through which a wire of the speaker drive units passes is provided; and wherein one end portion of the pipe member is secured on the supporting plate and penetrates through a through hole formed in the pedestal thereby being adhered thereon.

A sixth aspect of the present invention provides an electroacoustic transducer according to the first aspect; wherein the multifaced diaphragm assembly is formed into the nearly spherical shell shape only using the diaphragm; wherein at least one of the diaphragm segments of the diaphragm has in the center portion thereof a through hole; wherein at least one pipe member through which a wire of the speaker drive units passes is provided; and wherein the pipe member penetrates through the through hole and the one end portion thereof is supported by the speaker drive unit.

A seventh aspect of the present invention provides an electroacoustic transducer according to the first aspect; wherein the multifaced diaphragm assembly is formed into the nearly spherical shell shape only using the diaphragm; wherein at least one of the diaphragm segments of the diaphragm has in the center portion thereof a through hole; wherein at least one pipe member through which a wire of the speaker drive units passes is provided; and wherein the pipe member penetrates through the through hole and the one end portion thereof is supported by the speaker drive unit.

An eighth aspect of the present invention provides an electroacoustic transducer according to the seventh aspect, wherein the diaphragm connecting member has a greater flexibility than that of the diaphragm segment.

A ninth aspect of the present invention provides an electroacoustic transducer comprising; a multifaced diaphragm assembly which includes a diaphragm formed by combining a plurality of polygonal diaphragm segments and has a nearly spherical shell shape; a plurality of speaker drive units which include a speaker housing, a bobbin that is supported vibratably by the speaker housing and adhered at one end portion thereof to an inner center portion of each of the diaphragm segments, a voice coil that is attached on the other end portion of the bobbin, a yoke, and a magnet that generates a drive force in the voice coil along with the yoke, each of the plurality of speaker drive units being arranged inside the multifaced diaphragm assembly so as to oppose respectively the diaphragm segments; and a multifaced mounting pedestal assembly which is formed including a plurality of speaker mounting pedestals into a nearly spherical shell shape, each of the speaker mounting pedestals having a shape of a polygonal pyramid or a polygonal pyramid pedestal and having a polygonal face which opposes respectively the diaphragm segments and the speaker drive unit is attached on, and housed in the multifaced diaphragm assembly.

A tenth aspect of the present invention provides an electroacoustic transducer according to the ninth aspect, wherein the multifaced mounting pedestal assembly is configured so that each of the speaker mounting pedestals is combined with each other through concave-convex fitting, for example, by providing a projection and a hole in the outer peripheral surface of each speaker mounting pedestal so that the projection is fitted into the hole between the every neighboring two mounting pedestals.

An eleventh aspect of the present invention provides an electroacoustic transducer according to the ninth aspect, wherein the multifaced diaphragm assembly includes as part thereof at least one pedestal having the same outer shape as the diaphragm segment thereby being formed into the nearly spherical shell shape.

An twelfth aspect of the present invention provides an electroacoustic transducer according to the eleventh aspect;

wherein the multifaced mounting pedestal assembly has at least one supporting pedestal having substantially the same outer shape as the speaker mounting pedestal thereby being formed into the nearly spherical shell shape, the supporting pedestal opposing the pedestal; wherein at least one pipe member through which a wire of the speaker drive units passes is provided; and wherein one end portion of the pipe member is secured by the supporting pedestal and penetrates through a through hole formed in the pedestal thereby being adhered thereon.

A thirteenth aspect of the present invention provides an electroacoustic transducer according to the ninth aspect, wherein the multifaced diaphragm assembly is formed into the nearly spherical shell shape only using the diaphragm and has a through hole in the center portion of at least one of the diaphragm segments in the diaphragm; wherein at least one pipe member through which a wire of the speaker drive unit passes is provided; and wherein the pipe member penetrates through the through hole and one end portion of the pipe member is supported by the speaker drive unit.

A fourteenth aspect of the present invention provides an electroacoustic transducer according to the ninth aspect; wherein the multifaced diaphragm assembly is formed into a nearly spherical shell shape only using the diaphragm and has a through hole in the center portion of at least one of the diaphragm segments in the diaphragm; wherein at least one pipe member through which a wire of the speaker drive unit passes is provided; and wherein the pipe member penetrates through the through hole, and one end portion of the pipe member penetrates through the center portion of the speaker drive unit thereby being supported by the speaker mounting pedestal on which the speaker drive unit is attached.

A fifteenth aspect of the present invention provides an electroacoustic transducer according to the ninth aspect, further comprising a plurality of diaphragm connecting members that connect an inner edge portion of the diaphragm segment constituting the multifaced diaphragm assembly and the speaker mounting pedestal constituting the multifaced speaker mounting assembly.

A sixteenth aspect of the present invention provides an electroacoustic transducer according to the fifteenth aspect, wherein the diaphragm connecting member has a greater flexibility than that of the diaphragm segment.

According to the first aspect of the present invention, there is provided an omnidirectional point source of sound as a pulsating sphere through the diaphragm obtained by combining the plurality of the polygonal diaphragm segments, the point source enabling to reduce dips appearing in the frequency response of the reproduced sound obtained by the vibration of each diaphragm segment, since the multifaced diaphragm assembly formed including the diaphragm formed by combining the plurality of polygonal diaphragm segments and the multifaced speaker housing assembly having a nearly spherical shell shape obtained by combining the peripheral surfaces of the plurality of the neighboring speaker housings is housed inside the multifaced diaphragm assembly when the one end portion of each bobbin of each speaker drive unit is adhered to the center portion of the inner surface of each diaphragm segment to obtain the electroacoustic transducer. In addition, since the plurality of the speaker drive units are attached on the multifaced speaker housing assembly obtained by combining the plurality of the speaker housings into a nearly spherical shell shape, a separate multifaced supporting member for attaching the plurality of speaker drive units thereon is unnecessitated, thereby providing the electroacoustic transducer at a lower cost.

According to the second aspect of the present invention, the multifaced speaker housing assembly can be assembled with high positional accuracy, since the outer peripheral surfaces of each of the speaker housing are combined through a concave-convex fitting.

According to the third aspect of the present invention, since the multifaced speaker housing assembly has an air path to allow air between the inner and the outer portion thereof to pass therethrough, the air between the multifaced speaker housing assembly and the multi diaphragm assembly can flow into the inner area of the multifaced speaker housing assembly through the air path, thereby increasing the volume therein. Therefore, the resonance frequency fo shifts toward lower frequencies, thereby providing an improved acoustic characteristic especially in the lower-pitched range of sound.

According to the fourth aspect of the present invention, since the multifaced diaphragm assembly is formed into a nearly spherical shell shape by including at least one pedestal having the same outer shape as the diaphragm segment the at least one pedestal can support the diaphragm obtained by combining the plurality of the diaphragm segments and serve as the bottom face of the electroacoustic transducer. In addition, the pedestal is necessary when a plurality of the electroacoustic transducers are connected.

According to the fifth aspect of the present invention, since the multifaced speaker housing assembly is formed into a nearly spherical shell shape by including the one supporting plate having the same outer shape as the speaker housing, the supporting plate opposing the pedestal, and at least one pipe member for allowing the lead wire from each speaker drive unit to go therethrough is provided, the pipe member being secured at the one end portion thereof to the supporting plate, the at least one pedestal can support the diaphragm obtained by combining the plurality of the polygonal diaphragm segments and the pipe member can allow the lead wire of each voice coil provided in each speaker drive unit to be led out. In addition, the pipe member can support at least one of the electroacoustic transducer and connect a plurality of electroacoustic transducers.

According to the sixth aspect of the present invention, since the multifaced diaphragm assembly is formed into a nearly spherical shell shape only with the diaphragm; and the multifaced diaphragm assembly has the through hole in the center portion of at least one diaphragm segment in the diaphragm and the pipe member that allows the lead wire of each speaker drive unit to pass therethrough is provided, the pipe member being inserted into the through hole and supported at the one end portion thereof by the speaker drive unit, each diaphragm segment provided on all the faces of the multifaced diaphragm assembly can vibrate, thereby improving the vibration characteristic of the diaphragm obtained by combining all the diaphragm segments. Also, the pipe member can allow the lead wire of each voice coil provided in each speaker drive unit to be led out and support at least one electroacoustic transducer. Moreover, the pipe member can connect a plurality of the electroacoustic transducers.

According to the seventh aspect of the present invention, since there is provided the plurality of the diaphragm connecting member that connects the edge portion of the inner surface of each diaphragm segment, the edge portion being where the neighboring diaphragms are combined, and each speaker housing constituting the multifaced speaker housing assembly, each diaphragm segment in the multifaced diaphragm assembly is prevented from deforming by its self weight even when the multifaced diaphragm assembly is relatively large or when each edge member in the multifaced diaphragm assembly is formed of a soft material, thereby providing a better acoustic characteristic.

According to the eighth aspect of the present invention, the diaphragm connecting member has a greater flexibility than that of the diaphragm segment, thereby supporting the diaphragm segment without affecting the vibration of the diaphragm segment.

According to the ninth aspect of the present invention, there is provided an omnidirectional point source of sound as a pulsating sphere, the point source enabling to reduce dips appearing in the frequency response obtained by the vibration of each diaphragm segment, since the multifaced diaphragm assembly is formed including the diaphragm obtained by combining the polygonal diaphragm segments; the plurality of speaker drive units are arranged so as respectively to oppose the diaphragm segment inside the multifaced diaphragm assembly; and there is provided the multifaced mounting pedestal assembly that is formed including the plurality of the speaker mounting pedestals into the nearly spherical shell shape, the speaker mounting pedestal having a shape of the polygonal pyramid or the polygonal pyramid pedestal and having a polygonal face that opposes the diaphragm segment and the speaker drive unit is attached on, and is housed in the multifaced diaphragm assembly. In addition, when the electroacoustic transducer is mass-produced, the plurality of the speaker mounting pedestals (polygonal pyramids or polygonal pyramid pedestals) that each have the speaker drive unit attached in the center portion of the top face thereof are prepared and the speaker mounting pedestals having the speaker drive unit attached thereon are combined with one another to obtain the multifaced mounting assembly, thereby improving the productivity of the electroacoustic transducer.

According to the tenth aspect of the present invention, the multifaced mounting pedestal assembly is assembled by combining the outer peripheral surfaces of each speaker mounting pedestal through a concave-convex fitting, thereby assembling the multifaced mounting pedestal assembly with higher positional accuracy.

According to the eleventh aspect of the present invention, since the multifaced diaphragm assembly is formed including as part thereof the at least one pedestal having the same outer shape as the diaphragm segment into a nearly spherical shell shape, the at least one pedestal can support the diaphragm obtained by combining the plurality of the polygonal diaphragm segments and serve as the bottom face of the electroacoustic transducer. In addition, the pedestal is necessary when a plurality of the electroacoustic transducers are connected.

According to the twelfth aspect of the present invention, since the multiface mounting pedestal assembly is formed including at least one supporting pedestal having substantially the same shape as the speaker mounting pedestal into a nearly spherical shape; the supporting pedestal opposes the pedestal; there is provided the at least one pipe member that allows the lead wire of each speaker drive unit to pass through; and the one end of the pipe member is supported by the supporting pedestal and adhered into the through hole provided in the pedestal, the at least one pedestal can support the diaphragm obtained by combining the plurality of the polygonal diaphragm segments and the pipe member can allow the lead wire of the voice coil provided in each speaker drive unit to be led out. Also, the pipe member can support at least one electroacoustic transducer and furthermore a plurality of the electroacoustic transducers.

According to the thirteenth aspect of the present invention, since the multifaced diaphragm assembly is formed into a nearly spherical shell shape only using the diaphragm and the through hole in the center portion of the at least one diaphragm segment in the diaphragm; the pipe member through which the lead wire of each speaker drive unit passes is provided; and the pipe member penetrates through the through hole and the one end portion of the speaker drive unit is supported by the speaker drive unit, all the diaphragm segments provided on all the faces of the multifaced diaphragm assembly can vibrate in unison, thereby improving the acoustic characteristic. Also, the pipe member can allow the lead wire of the voice coil provided in each speaker drive unit to be led out and connect a plurality of the electroacoustic transducers.

According to the fourteenth aspect of the present invention, since the multifaced diaphragm assembly is formed into a nearly spherical shell shape only using the diaphragm and has the through hole in the center portion of the at least one diaphragm segment in the diaphragm; the pipe member through which the lead wire of each drive unit passes is provided; and the pipe member penetrates through the through hole and the one end portion thereof penetrates through the center portion of the speaker drive unit thereby being supported by the speaker mounting pedestal having the speaker drive unit attached thereon, all the diaphragm segments provided on all the faces of the multifaced diaphragm assembly can vibrate, thereby improving the acoustic characteristic of the diaphragm obtained by combining all the diaphragm segments. Also, the pipe member can allow the lead wire of each voice coil provided in each speaker drive unit to be led out and support the at least one electroacoustic transducer, or even a plurality of electroacoustic transducers.

According to the fifteenth aspect of the present invention, since the plurality of the diaphragm connecting members that connect the inner edge portion of each of the diaphragm segments constituting the multifaced diaphragm assembly and the speaker mounting pedestal constituting the multifaced mounting pedestal assembly, each diaphragm segment in the multifaced diaphragm assembly is prevented from deforming by its self-weight even when the multifaced diaphragm assembly is relatively large or when each edge member in the multifaced diaphragm assembly is formed of a soft material, thereby providing a better acoustic characteristic.

According to the sixteenth aspect, since the diaphragm connecting member has a greater flexibility than that of the diaphragm segment, the diaphragm segment is supported without affecting the vibration of the diaphragm segment.

DESCRIPTION OF THE PREFERRED EMBODIMENTS

Preferred embodiments 1 through 6 according to the present invention will be described in detail, referring to FIGS. 4 to 30 accompanied for purposes of illustration only.

An electroacoustic transducer according to the present invention is configured in a way that a multifaced diaphragm assembly having a shape of a nearly spherical shell is created so as to include a diaphragm obtained by combining a plurality of polygonal diaphragm segments and then a plurality of speaker drive units are arranged three dimensionally and radially inside the multifaced diaphragm assembly so as to respectively oppose the corresponding diaphragm segment.

By the way, although the regular pentagonal diaphragm segment is exemplified as the polygonal diaphragm segment and the multifaced diaphragm assembly is formed into a nearly spherical shell shape so as to include the diaphragms obtained by combining a plurality of the regular pentagonal diaphragm segments in the embodiments 1, 2, 4, and 5 below, the shape of the polygonal diaphragm segments is not limited to a pentagon. Any diaphragm segment having any polygonal shape may be used to form the diaphragm having any number of the diaphragm segments.

In addition, although the regular pentagonal diaphragm segment is exemplified as the polygonal diaphragm segment and a multifaced diaphragm assembly is formed into a nearly spherical shell shape so as to include the diaphragms obtained by combining a plurality of the regular pentagonal diaphragm segments in the embodiments 3 and 6 below, the shape of the polygonal diaphragm segments is not limited to a pentagon. Any diaphragm segment having any polygonal shape may be used to form the diaphragm having any number of the diaphragm segments.

(A First Embodiment)

Figure 1:
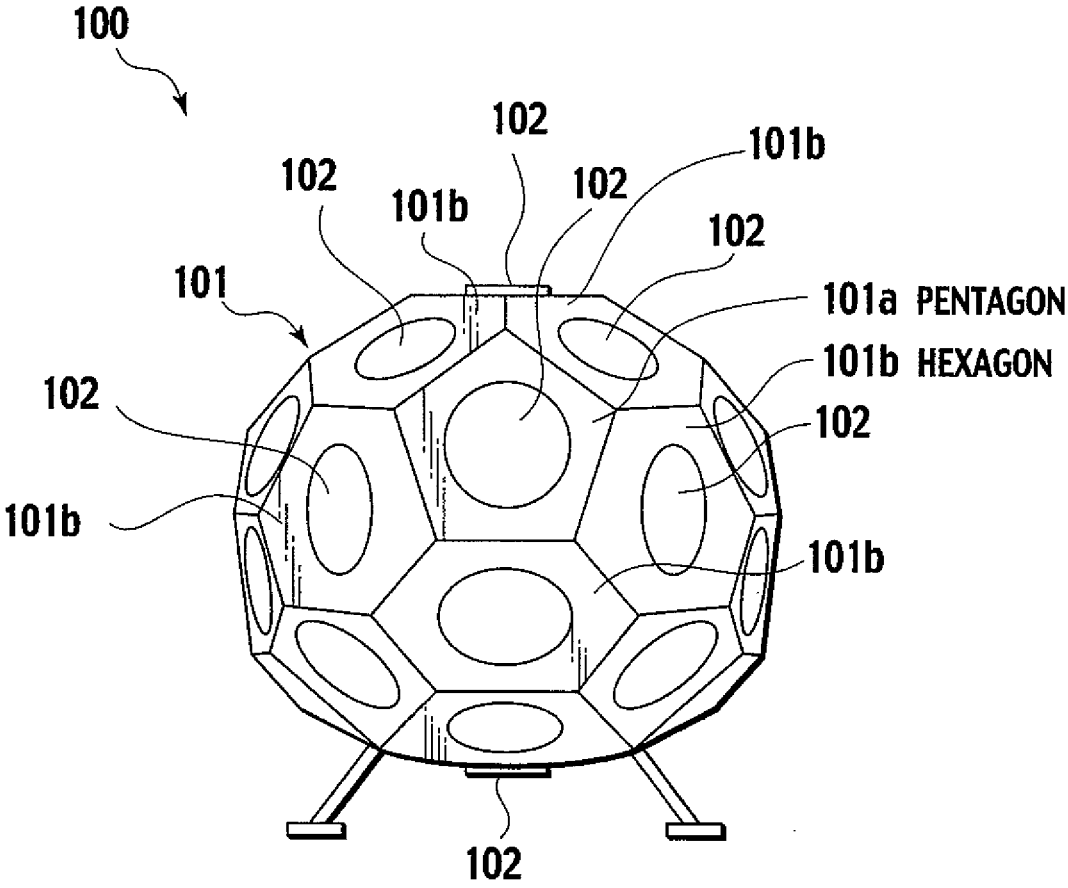
FIG. 1 RELATED ART
FIG. 1 is a perspective view of an example of a related art point-source omnidirectional speaker system.
Figure 2:
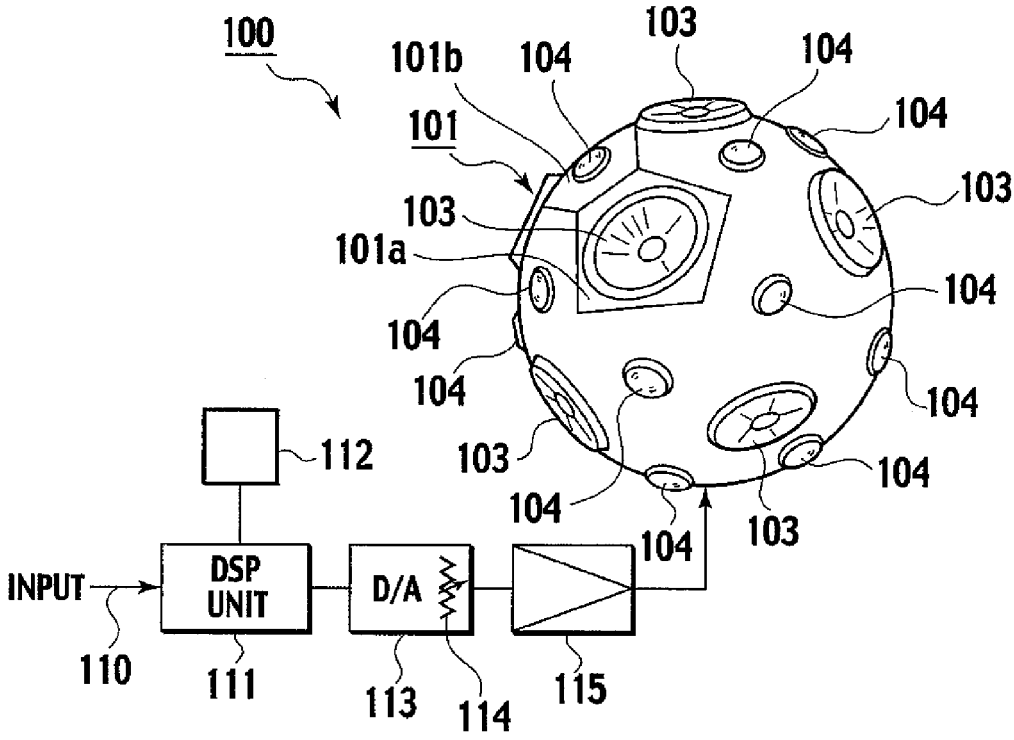
FIG. 2 RELATED ART
FIG. 2 is a block diagram of the related art point-source omnidirectional speaker system.
Figure 3:
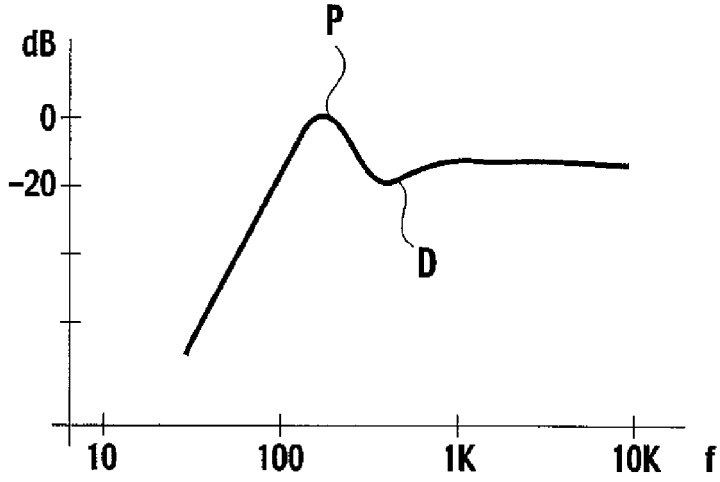
FIG. 3 RELATED ART
FIG. 3 is a frequency response of a speaker unit constituting the related art point-source omnidirectional speaker system, in which peaks and dips in the frequency response is schematically represented.
Figure 4:
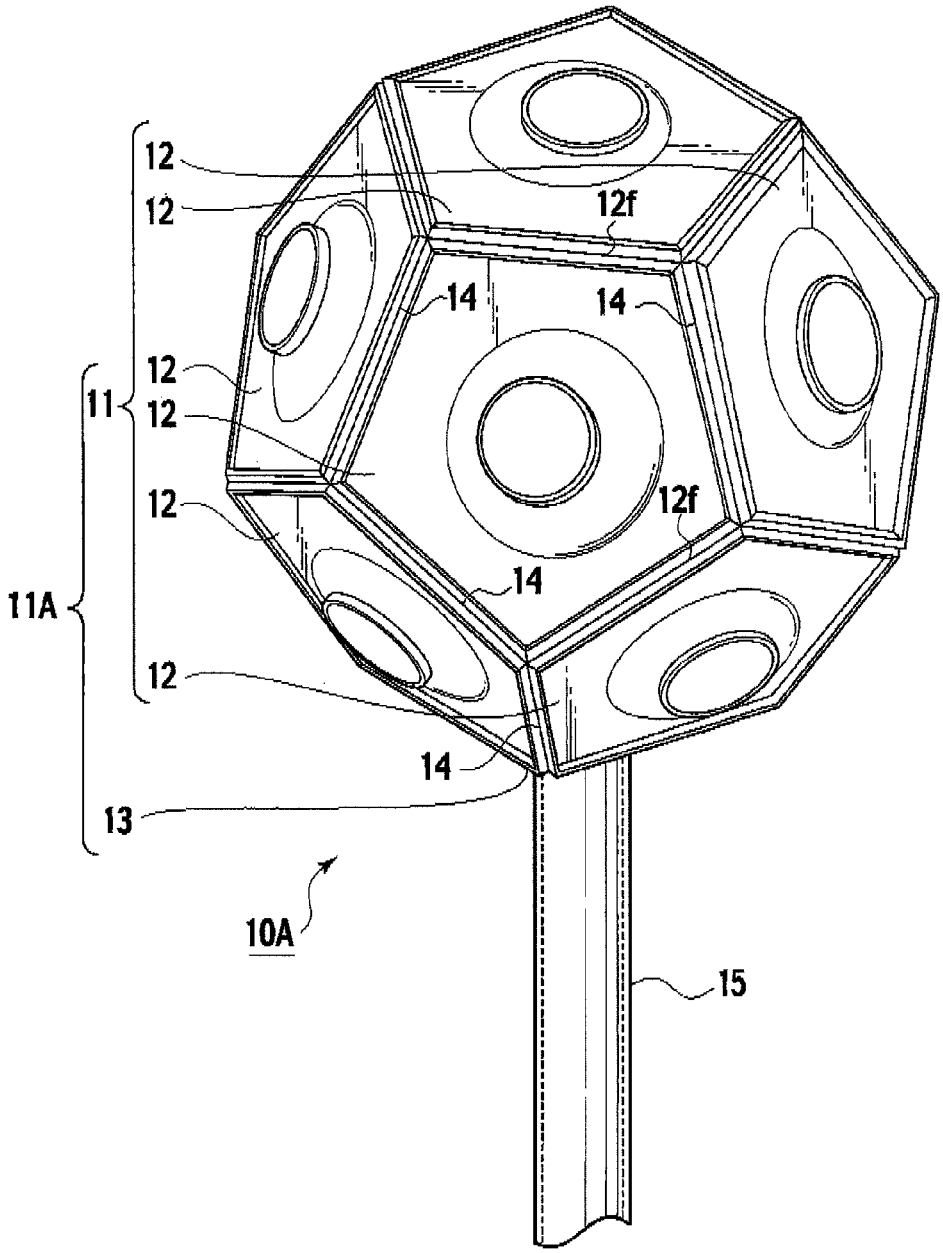
FIG. 4 is a perspective view of an electroacoustic transducer according to a first embodiment, seen obliquely from the front.
Figure 5:
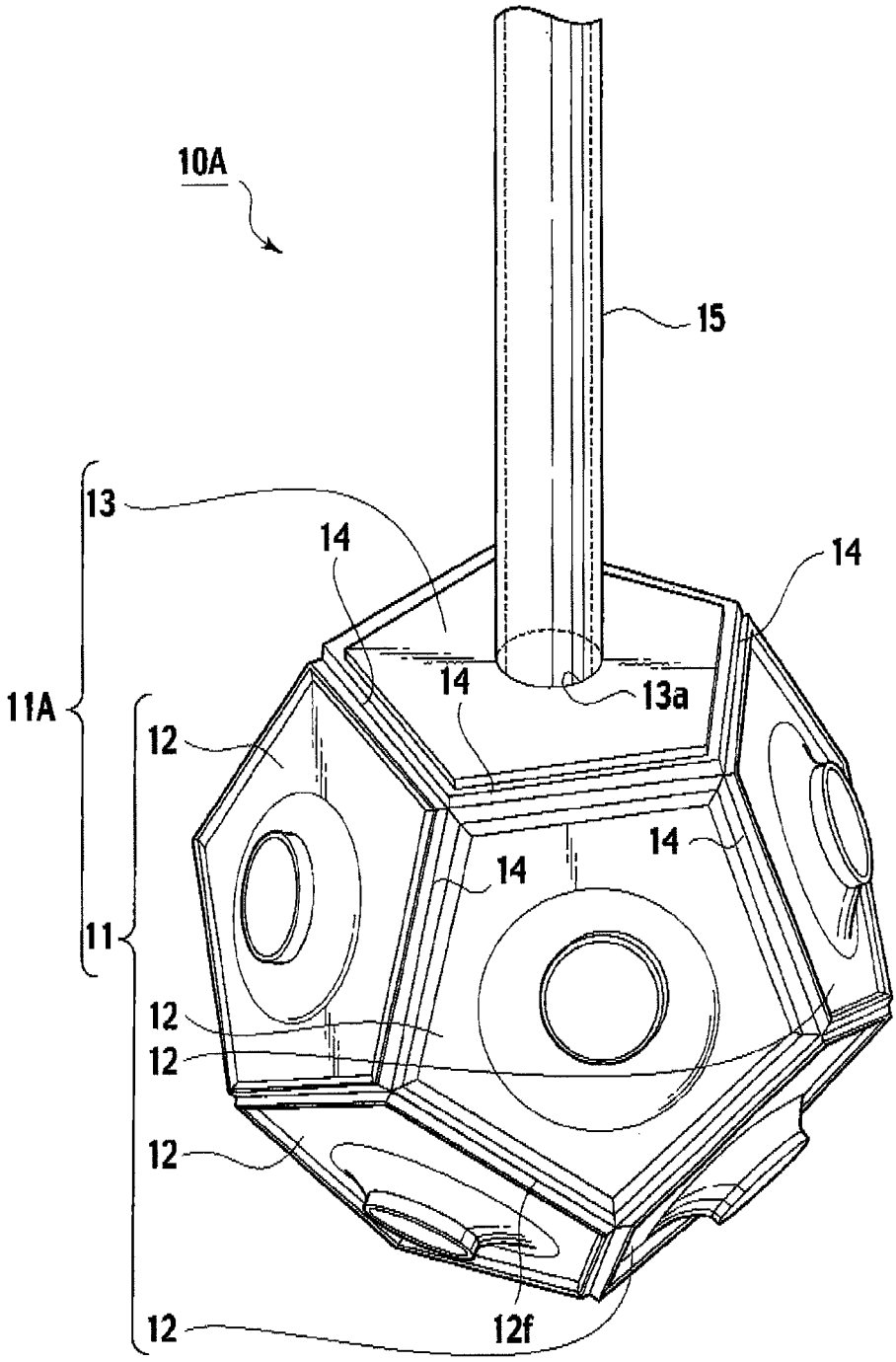
FIG. 5 is another perspective view of the electroacoustic transducer according to the first embodiment, seen obliquely from the bottom.
Figure 6:
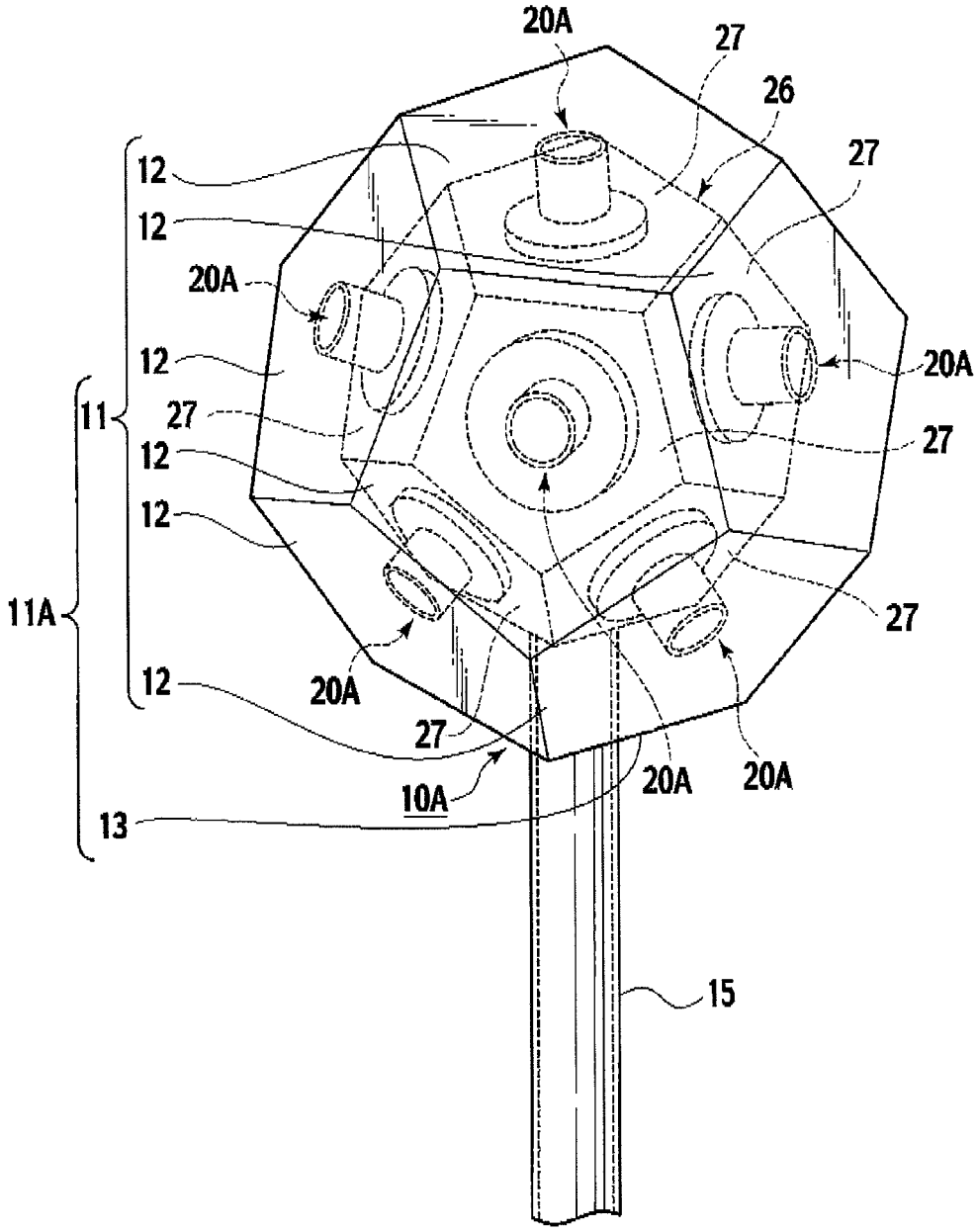
FIG. 6 is yet another perspective view outlining the electroacoustic transducer according to the first embodiment.

FIG. 4 is a perspective view of an electroacoustic transducer according to a first embodiment, seen obliquely from the front. FIG. 5 is another perspective view of the electroacoustic transducer according to the first embodiment, seen obliquely from the bottom. FIG. 6 is yet another perspective view showing exemplary the appearance of the electroacoustic transducer according to the first embodiment.

As shown in FIGS. 4 and 5, an electroacoustic transducer 10A according to the first embodiment of the present invention is comprised of a multifaced diaphragm assembly 11A that are includes a diaphragm 11 having a shape of a nearly spherical shell, the diaphragm 11 being obtained by combining a plurality of diaphragm segments 12 formed of a resin sheet material or the like into a polygon, and a plurality of speaker drive units 20A (FIG. 6) that are three dimensionally and radially arranged inside the multifaced diaphragm assembly 11A so as to respectively oppose each diaphragm segment 12, thereby providing an omnidirectional point source of sound, which is close to a pulsating sphere.

As described later, when the aforementioned diaphragm 11 is made, there is employed a method in which the plurality of the polygonal diaphragm segments 12 are two-dimensionally disposed and then the plurality of the diaphragm segments 12 are formed into a nearly spherical shell. On the other hand, the plurality of the speaker drive units 20A (FIG. 6) that are to be arranged so as to respectively oppose the plurality of the diaphragm segments 12 are made into a unit without any diaphragms.

In other words, in the first embodiment, there is obtained the multifaced diaphragm assembly 11A, which has a total of 12 faces, by combining the diaphragm 11 made of the 11 diaphragm segments 12 formed of a resin sheet material or the like into a regular pentagon and a regular pentagonal pedestal 13 that is rigidly formed so as to have the same shape as the diaphragm segments 12, the pedestal 13 being to be arranged in a position corresponding to the bottom face of the diaphragm 11. The neighboring diaphragm segments 12 are combined via an edge portion 12*f* thereof and an edge member 14.

When the neighboring regular pentagonal diaphragm segments 12 are combined together and also the regular pentagonal pedestal 13 to be the bottom is combined with the neighboring regular pentagonal diaphragm segments 12, each edge of the pentagons to be combined is combined via the edge member 14 having flexibility, the edge member being made of rubber or the like.

In addition, as illustrated in FIG. 5, in the center portion of the regular pentagonal pedestal 13 is provided a through hole 13*a*, through which a pipe member 15 serving as a wire duct and a supporting member is inserted. One end portion of the pipe member 15 has a screw portion (not shown) which is screwed fixedly into a supporting plate (a pentagonal plate, hereinafter) 28 (FIG. 10B) having substantially the same outer shape as a speaker housing 27 within a multifaced speaker housing assembly 26 (to be described later), the pentagonal plate serving as the bottom. Wires of eleven speaker drive units 20A attached in the multifaced speaker housing assembly 26 can pass through the inside of the pipe member 15 and be led out.

The regular pentagonal pedestal 13 is supported by the pipe member 15 by applying an adhesive between the through hole 13*a* of the pedestal 13 and the outer circumferential surface of the pipe member 15. At this time, the eleven-faced diaphragm 11 of the twelve-faced diaphragm assembly 11A is supported by each edge of the regular pentagonal pedestal 13 via each edge member 14.

In addition, the speaker drive units 20A are arranged three dimensionally and radially so as to oppose each inner face of the eleven diaphragm segments 12 inside the multifaced diaphragm assembly 11 formed into a nearly spherical shell, as illustrated in FIG. 6.

The eleven speaker drive units 20A are assembled into the multifaced speaker housing assembly 26 that is twelve faced, similar to and smaller than the multifaced diaphragm assembly 11A as follows. That is, first of all, the eleven individual speaker drive units 20A are combined respectively with the eleven speaker housings 27 that are formed into substantially a regular pentagon, which is the same shape as the regular pentagonal diaphragm segment 12, though different in size. Then, the eleven speaker housings 27 and one pentagonal plate 28 (FIG. 10B) are combined into a nearly spherical shell. Here, the pentagonal plate 28 has the same pentagonal shape as the speaker housing 27 and is to be provided so as to oppose the pedestal 13 of the multifaced diaphragm assembly 11A, thereby serving as a bottom face of the multifaced speaker housing assembly 26.

From the above configuration, the multifaced speaker housing assembly 26, which has a total of 12 faces consisting of the eleven speaker housings 27 and the one pentagonal plate 28 (FIG. 10B), is housed inside the multifaced diaphragm assembly 11A, which has a total 12 faces consisting of the eleven diaphragm segments 12 and the pedestal 13.

Next, a configuration of the electroacoustic transducer 10A according to the first embodiment of the present invention will be described in detail referring to FIGS. 7 through 11.

Figure 7:
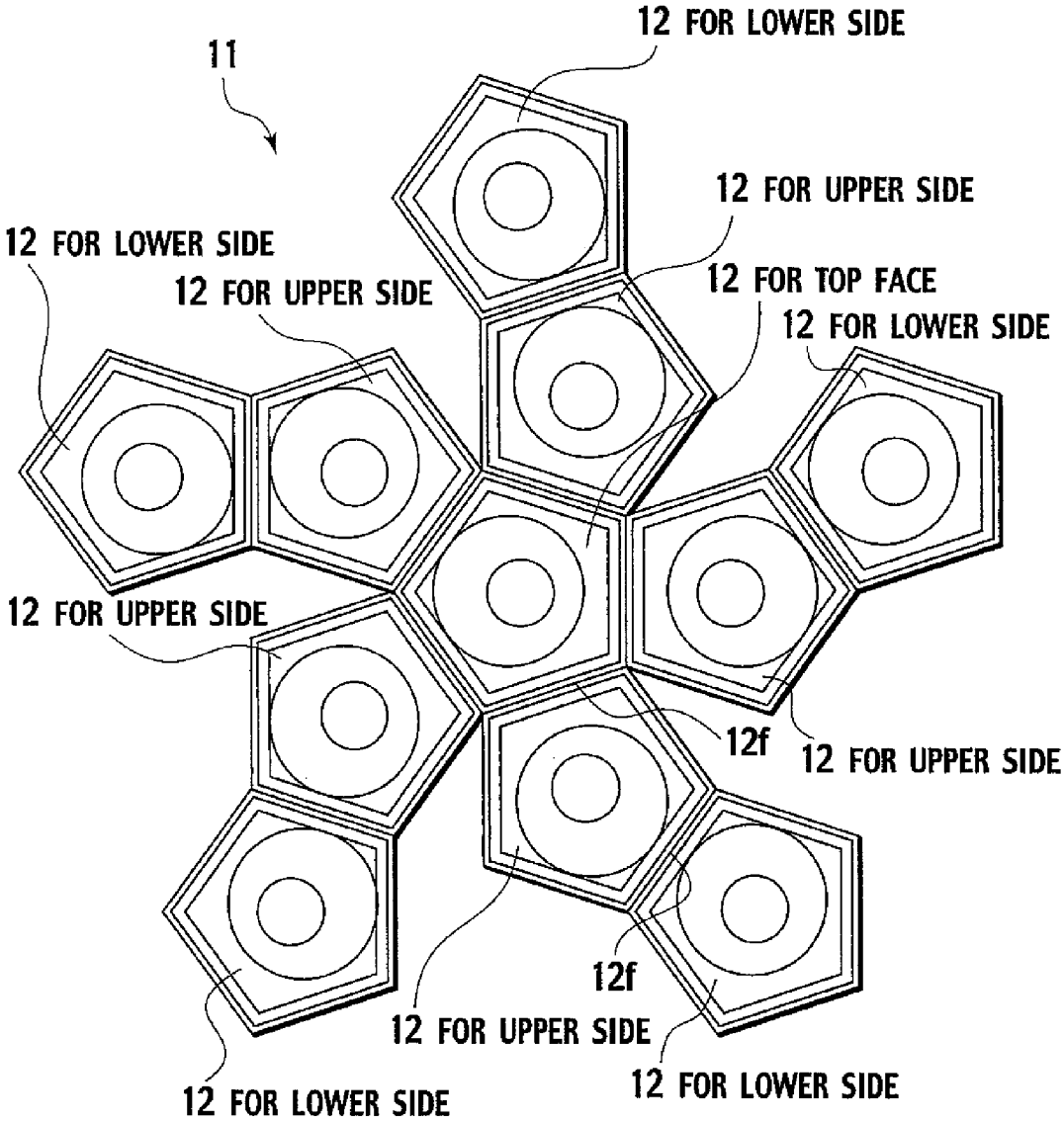
FIG. 7 is a plane view showing a planar layout of a diaphragm to be obtained by connecting 11 regular pentagonal diaphragm segments, in the electroacoustic transducer according to the first embodiment of the present invention.
Figure 8:
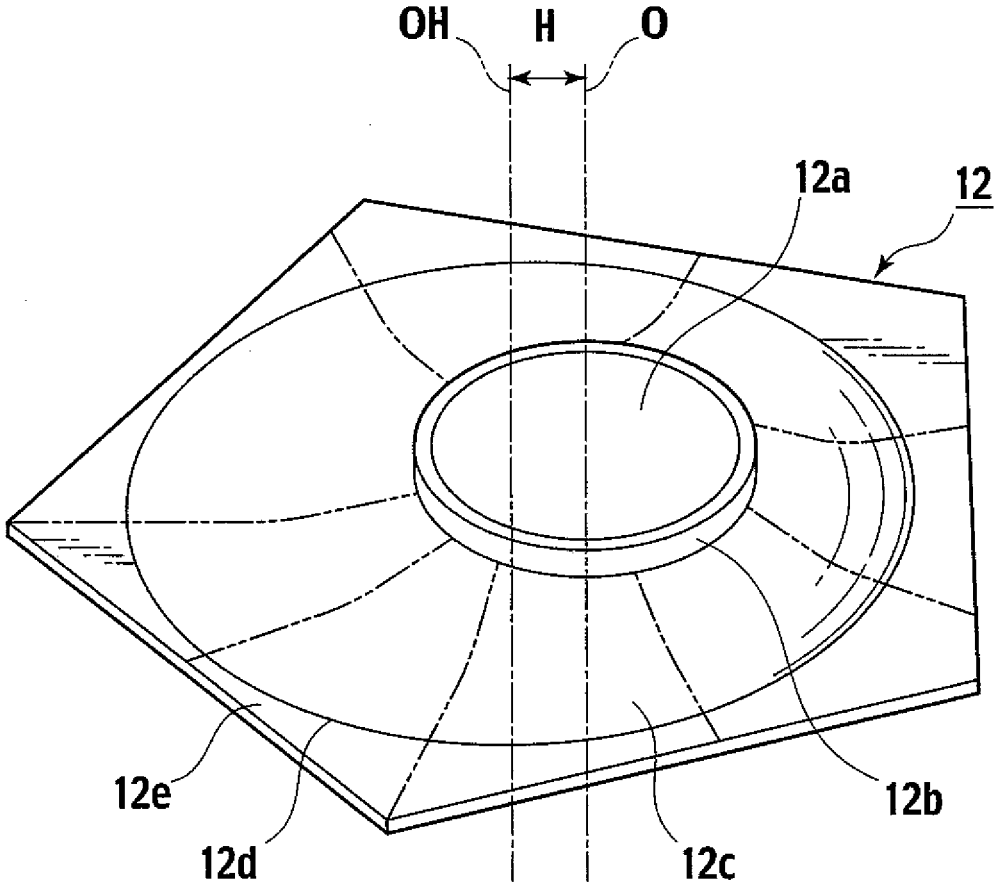
FIG. 8 is an enlarged perspective view of one of the regular pentagonal diaphragm segments shown in FIG. 7.
Figure 9:
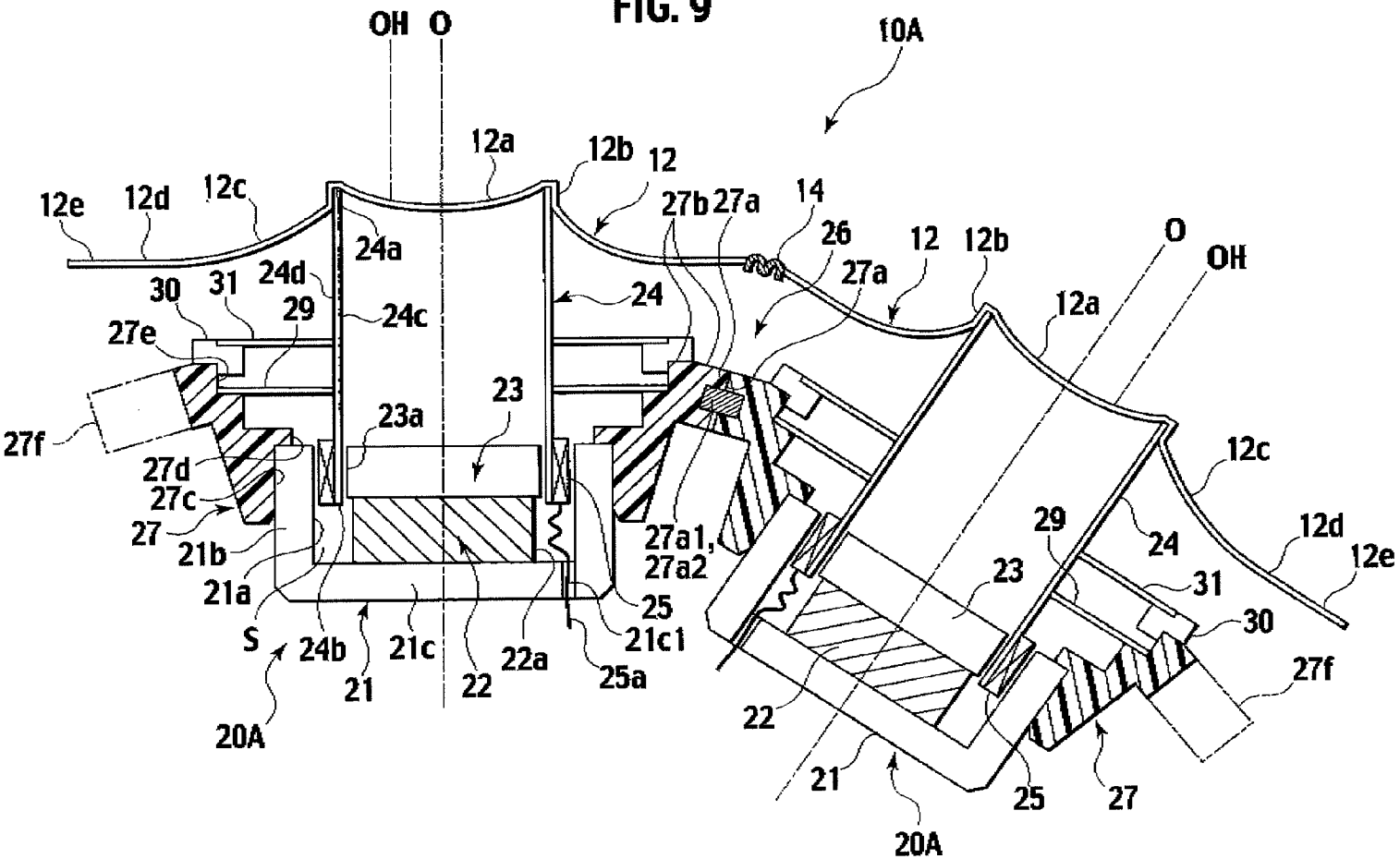
FIG. 9 is an enlarged cross-sectional view showing that neighboring speaker drive units are assembled, in the electroacoustic transducer according to the first embodiment of the present invention.
Figure 10A:
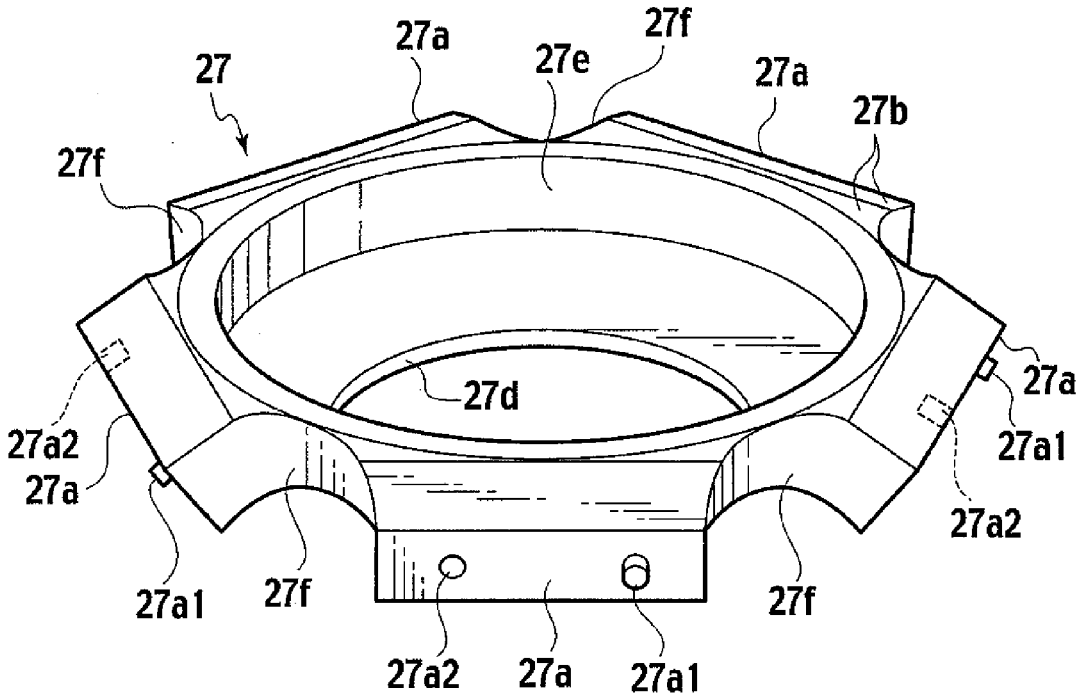
FIG. 10A is an enlarged perspective view of a speaker housing shown in FIG. 9.
Figure 10B:
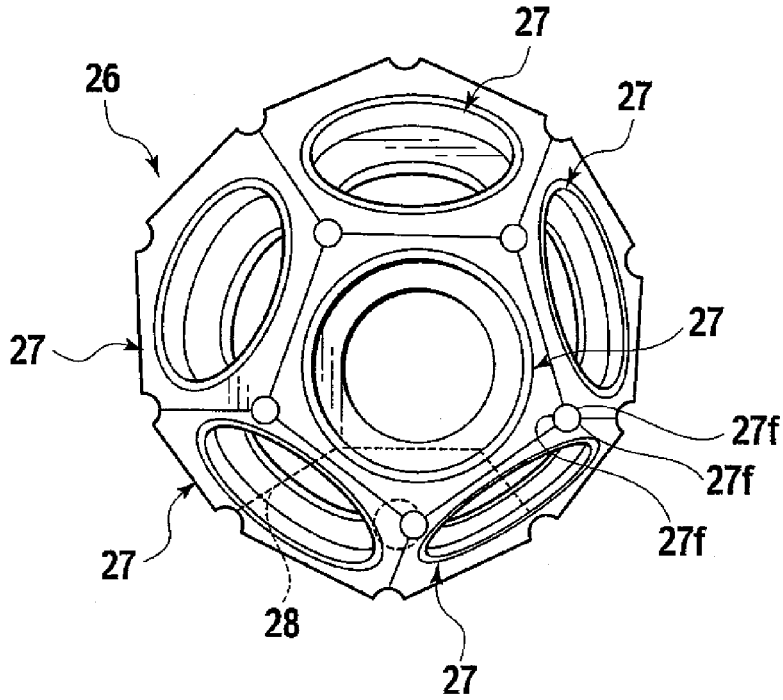
FIG. 10B is a perspective view of a multifaced speaker housing assembly obtained by combining a plurality of the speaker housings and a pentagonal plate for the bottom face.
Figure 11:
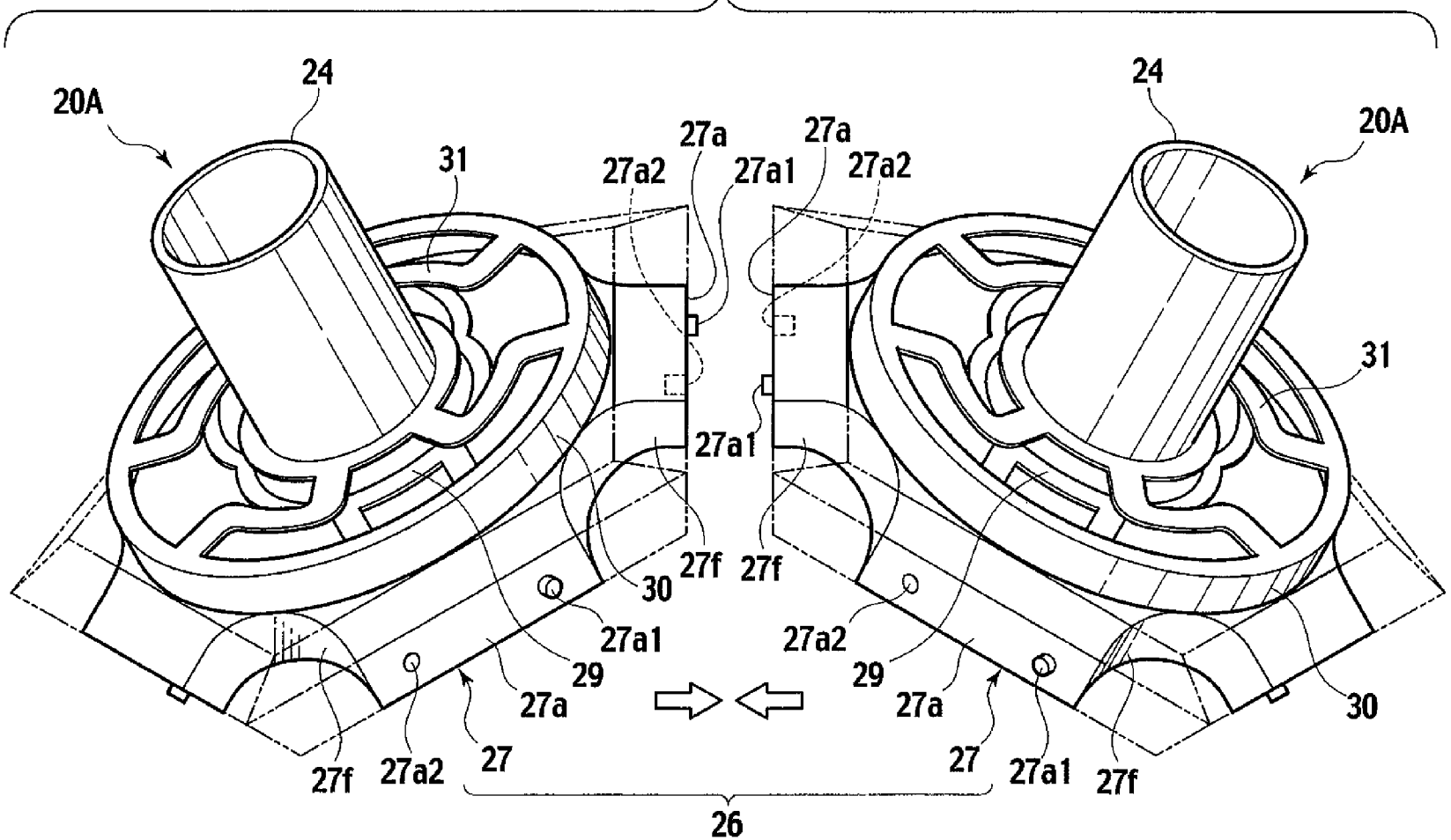
FIG. 11 is a perspective view showing that the neighboring speaker drive units are being assembled, in the electroacoustic transducer according to the first embodiment of the present invention.

FIG. 7 is a planar layout of the diaphragm to be obtained by connecting 11 regular pentagonal diaphragm segments, in the first embodiment of the electroacoustic transducer according to the present invention. FIG. 8 is an enlarged perspective view of the regular pentagonal diaphragm segment shown in FIG. 7. FIG. 9 is an enlarged cross-sectional view showing that the neighboring speaker drive units are assembled, in the first embodiment of the electroacoustic transducer according to the present invention. FIG. 10A is an enlarged perspective view of a speaker housing shown in FIG. 9. FIG. 10B is a perspective view of the multifaced speaker housing assembly obtained by combining the speaker housings and the pentagonal plate as the bottom face. FIG. 11 is a perspective view showing that the neighboring speaker drive units are being assembled, in the first embodiment of the electroacoustic transducer according to the present invention.

The diaphragm 11 to be used in the electroacoustic transducer 10A according to the first embodiment of the present invention is prepared in advance by two-dimensionally laying out the eleven regular pentagonal diaphragm segments 12 that has been formed of a resin sheet material or the like into a regular pentagon for example, as shown in FIG. 7. The resin sheet material that can be used to make the diaphragm segment 12 is for example but not limited to a foam polypropylene sheet material, which is excellent in vibration characteristic.

Assuming that the regular diaphragm segment 12 positioned in the center of FIG. 7 is to form a top face, five diaphragm segments to form a top-side face are respectively attached to each edge (five edges) of the top face diaphragm segment 12 and another five diaphragm segments to form a bottom-side face are respectively attached to the five top-side face diaphragm segment. While the edge portion 12*f* is formed in the edges of the neighboring two diaphragm segments that have been attached, the separated edges of the neighboring two diaphragm segments to be combined are then combined together by affixing the edge member 14 (FIGS. 4 and 5) to those edges using an adhesive. As a result, the 11 diaphragm segments 12 are formed into a nearly spherical shell.

Referring to FIG. 8 that shows the regular pentagonal diaphragm segment 12 constituting a part of the diaphragm 11 (FIGS. 4 through 7) under magnification, the regular pentagonal diaphragm segment 12 is configured so as to have a concave spherical surface portion 12*a* that has a concave shape having an center axis O and is formed upwardly protrusively, and a convex ring portion 12*b* that co-axially surrounds the concave spherical surface portion 12*a* and is formed protrusively. Along an inner (reverse) surface of the convex ring portion 12*b* is adhered one end portion of a bobbin 24 (FIG. 9) of the speaker drive unit 20A (to be explained later), so that the center axis O of the regular pentagonal diaphragm segment 12 serves as the center axis of the bobbin 24 of the speaker drive unit 20A.

By the way, although the concave spherical surface portion 12*a* is formed in the center portion of the regular pentagonal diaphragm segment 12 in the first embodiment, a flat circular surface portion or a convex surface portion that is slightly protruded like a dome may be formed instead of the concave spherical surface portion 12*a*.

In addition, connecting to the outer circumference of the convex ring portion 12*b* of the diaphragm segment 12, a slope surface portion 12*c* is formed. The slope surface portion 12*c* has the eccentric axis OH that is eccentric by an amount of H in relation to the center axis O of the diaphragm segment 12. The slope surface portion 12*c* is formed to be gently sloped toward the outer peripheral flat surface portion 12*e*, like in a shape of cone. The boundary between the slope surface portion 12*c* of the diaphragm segment 12 and the flat surface portion 12*e* is a circle 12*d* having a relatively large diameter. The circle 12*d* has as its center the aforementioned eccentric axis OH and is eccentric by the amount H in relation to the convex ring portion 12*b*. In other words, the slope surface portion 12*c* is formed so as to slope upward from the eccentric circle 12*d* toward the convex ring portion 12*b*, in the diaphragm segment 12.

In FIG. 8, there are indicated two-dot chain lines for the sake of easy understanding of the slope of the slope surface portion 12*c* of the diaphragm segment 12. As indicated, the lines are drawn short and steep in the right hand side of the slope surface portion 12*c*, while long and gentle in the left hand side. By the way, the shape of the circle 12*d*, which is the outer circumference of the slope surface portion 12*c*, is not limited to a complete circle, but may be an ellipsoid.

The amount of H and a diameter of the circle 12*d* may be determined in accordance with the outer size of the regular pentagonal diaphragm segment 12, though as the amount of H is increased, the acoustic characteristic is improved as explained later.

In addition, the slope surface portion 12*c* and the circle 12*d* of the regular pentagonal diaphragm segment 12 are preferably eccentric toward any one of the vertices of the regular pentagon in order to improve acoustic characteristic, as far as only one diaphragm segment 12 is concerned.

Furthermore, when it comes to the eleven diaphragm segments 12, as a whole, which are combined to form a nearly spherical shell, the slope surface portion 12*c* and the circle 12*d* of the five upper side diaphragm segments 12 are preferably eccentric toward the five lower side diaphragm segments 12, and the slope surface portion 12*c* and the circle 12*d* of the five lower side diaphragm segments 12 are preferably eccentric toward the five upper side diaphragm segments 12, whereas the slope surface portion 12*c* and the circle 12*d* of the top diaphragm segment 12 shown in FIG. 7 are arbitrarily eccentric. With this configuration, the slope surface portion 12*c* and the circle 12*d* of the five upper side diaphragm segments 12 and those of the five lower side diaphragm segments 12 are symmetrically eccentric in the up-down direction, so that the dips D (FIG. 14) are reduced in the frequency response of each diaphragm segment 12, thereby providing an improved acoustic characteristic.

The speaker drive units 20A that respectively oppose and vibrate the diaphragm segment 12 are assembled in such a way that each unit is concentrically combined together so as to have the intersecting point of the central axes of respective diaphragm segments is positioned at the center, as illustrated under magnification in FIG. 9. As described, the speaker drive unit 20A is configured as a unit without any diaphragm. Namely, after the speaker drive unit 20A is made, one end portion 24*a* of the bobbin 24 is adhered to the inner surface of the convex ring portion 12*b* of the diaphragm segment 12.

The aforementioned speaker drive units 20A are attached respectively to one of speaker housings 27 as a base for the speaker drive unit 20A, as described later, the speaker housings 27 being combined with one another.

Next, there will be described each constituting member of the speaker drive unit 20A. A yoke 21 is formed of a soft magnetic material and has a circular concave portion 21*a* made by hollowing the material and a ring-shaped outer wall portion 21*b* as an outer wall of the circular concave portion 21*a*. The circular concave portion 21*a* and the outer wall portion 21*b* are arranged coaxially.

Inside the circular concave portion 21*a* of the yoke 21, a cylindrical magnet 22 is adhered concentrically with the circular concave portion 21*a*, that is, so as to have the central axis thereof coincided with the central axis O of the diaphragm segment 12, using an adhesive. Also, the cylindrical magnet 22 is arranged leaving a ring-shaped gap S between the circular concave portion 21*a* and an outer circumferential surface 22*a* of the cylindrical magnet 22.

In addition, a cylindrical pole piece 23 is adhered on the cylindrical magnet 22 so as to have the center axis thereof coincided with the central axis O of the diaphragm segment 12 using an adhesive. The cylindrical pole piece 23 has an outer circumferential surface 23*a* having substantially the same diameter as that of the outer circumferential surface 22*a* of the magnet 22.

Moreover, the bobbin 24 is formed into a relatively long tubular shape using a non-magnetic resin material. The one end portion 24*a* of the bobbin 24 is adhered to the inner surface of the convex ring portion 12*b* that is formed around the central axis O of the diaphragm segment 12 after the speaker drive unit 20A is assembled. Also, the bobbin is arranged so that an inner circumferential surface 24*c* near another end portion 24*b* of the bobbin 24 opposes the outer circumferential surface of the pole piece 23, leaving a slight gap therebetween.

A ring-shaped voice coil 25 is adhered to an outer circumferential surface 24*d* near the other end portion 24*b* of the bobbin 24 using an adhesive. The other end portion 24*b* of the bobbin 24, in which the voice coil 25 is adhered, is inserted into the ring-shaped gap S formed between the ring-shaped outer wall portion 21*b* and the outer circumferential surface 23*a* of the pole piece 23, inside the circular concave portion 21*a* of the yoke 21.

The speaker housing 27 is formed of a non-magnetic resin material. The speaker housing 27 has five outer peripheral surfaces 27*a* and upper surfaces 27*b* that exist in the upper inner portion in relation to the outer peripheral surfaces 27*a*, respectively. In the speaker housing 27, a lower circular concave portion 27*c* in the inner lower area thereof is formed so that the center axis of the lower circular concave portion 27*c* coincides with the central axis O of the diaphragm segment 12. The lower circular concave portion 27*c* is formed by hollowing. To the lower circular concave portion 27*c* is inserted and adhered the ring-shaped outer wall portion 21*b* of the yoke 21 using an adhesive. In addition, the speaker housing 27 has a through hole 27*d* which positions above the lower circular concave portion 27*c* and thus the bobbin 24 is inserted into. The speaker housing 27 has an upper circular concave portion 27*e* formed concentrically in the inner upper area thereof. Furthermore, cut-out portions 27*f* to serve as an air path are formed so as to come between any neighboring two outer peripheral surfaces 27*a*.

Contacting the inner circumferential surface of the circular concave portion 27*e* formed on the upper area of the speaker housing 27, the outer portion of a first suspension 29 formed of polyimide or the like into a thin ring-shape is adhered using an adhesive. In addition, the inner circumferential portion of the first suspension 29 is adhered using an adhesive to a middle portion of the outer circumferential surface 24*d* of the bobbin 24. The first suspension 29 can vibrate in unison with the bobbin 24 in the direction of the center axis.

In addition, a ring-shaped space 30 is formed of a resin material into a ring shape having a predetermined thickness and adhered using an adhesive on the upper surface 27*b* of the speaker housing 27.

Moreover, a second suspension 31 is formed in the same manner as the aforementioned first suspension 29. The second suspension 31 is positioned above the first suspension 29. The outer circumferential portion of the second suspension 31 is adhered using an adhesive on the ring-shaped spacer 30 having a predetermined thickness, whereas the inner circumferential portion thereof is adhered using an adhesive to the outer circumferential surface 24*d* of the bobbin 24, which allows the second suspension 31 to vibrate in unison with the bobbin 24.

By the way, although a lead wire 25*a* of the voice coil 25 is led out from a bore 21*c*1 that is formed in the bottom surface 21*c* of the yoke 21 and then covered with an insulator in the first embodiment, the lead wire 25*a* of the voice coil 25 may be led out, for example, through a hole made in the speaker housing 27.

When the speaker drive unit 20A is assembled, the ring-shaped outer wall portion 21*b* of the yoke 21 is adhered using an adhesive in the lower circular concave portion 27*c* of the speaker housing 27, and then the cylindrical magnet 22 and the cylindrical pole piece 23 are stacked on the bottom surface 21*c* of the yoke 21 in such a way that the center axis thereof coincides with the central axis O of the diaphragm segment 12. In addition, with the voice coil 25 being adhered on the outer circumferential surface 24*d* near the other end portion 24*b* of the bobbin 24, the middle portion of the outer circumferential surface 24*d* of the bobbin 24 is supported vibratably by the first suspension 29 attached inside the upper circular concave portion 27*e* of the speaker housing 27 and the second suspension 31 attached through the ring-shaped spacer 30. Moreover, the inner circumferential surface 24*c* near the other end portion 24*b* of the bobbin 24 is arranged so as to oppose the outer circumferential surface 23*a* of the pole piece 23 leaving a slight gap therebetween.

After the speaker drive unit 20A is assembled, the one end portion 24*a* of the bobbin 24 is adhered using an adhesive along the inner surface of the convex ring portion 12*b* of the diaphragm segment 12, the convex ring portion 12*b* having a center axis that coincides with the central axis O of the diaphragm segment 12.

In the speaker drive unit 20A assembled from each constituting member as described above, the yoke 21, the magnet 22, the pole piece 23, and the voice coil 25 fixed firmly on the outer circumferential surface 24*d* of the bobbin 24 create a magnetic circuit. When a drive current is supplied to the voice coil 25, the magnetic circuit produces a driving force in the voice coil 25, thereby moving the bobbin 24 in the direction of the central axis O, the bobbin 24 being supported vibratably by the first and the second suspension 29, 31. Accordingly, the diaphragm segment 12 that is adhered on the one end portion 24*a* of the bobbin 24 vibrates to produce sound. When the eleven speaker drive units 20A are driven in unison, the eleven diaphragm segments 12 constituting the diaphragm 11 vibrate to produce sound (synthetic reproduced sound) obtained by mixing of sound produced by each diaphragm segment 12.

As illustrated in a magnified form in FIG. 10A, the aforementioned speaker housing 27 serves as a vital portion of the first embodiment, and is formed of a resin material so as to include five upper surfaces 27*b* positioning respectively in the upper inner portion of the outer peripheral surfaces 27*a*. Accordingly, the speaker housing 27 takes a shape of substantially the same regular pentagon as the regular pentagonal diaphragm segment 12.

Each outer peripheral surface 27*a* of the speaker housing 27 is inclined in such a way that the distance between the outer peripheral surface 27*a* and the central axis O of the diaphragm segment 12 decreases along the direction from the diaphragm segment 12 to the yoke 21. On each outer peripheral surface 27*a* is formed a pin 27*a*1 so as to protrude. Also, there is formed alongside of the pin 27*a*1 a fit-in hole 27*a*2 for the pin 27*a*1 to be fitted into.

The speaker housing 27 is formed so as to include the lower circular concave portion 27*c* (shown only in FIG. 9) formed by hollowing in the inner lower area thereof, the upper circular concave portion 27*e* formed by hollowing in the inner upper area thereof, and the through hole 27*d* formed by piercing between the lower circular concave portion 27*c* and the upper circular concave portion 27*e*, as described with reference to FIG. 9.

In addition, adjacent to both ends of the outer peripheral surface 27*a* of the speaker housing 27, there is formed the cut-out portion 27*f* having a shape of arc to serve as an air path.

The 12-faced speaker housing assembly 26 is obtained from the eleven speaker housings 27 formed as described and the one pentagonal plate 28 (FIG. 10B) as follows. First, the outer peripheral surface 27*a* of one of the speaker housings 27 is opposed to the mating outer peripheral surface 27*a* of the adjacent speaker housing 27. Then, the pin 27*a*1 protruding from the outer peripheral surface 27*a* of the one speaker housing 27 is fitted into the fit-in hole 27*a*2 provided in and on the surface of the mating outer peripheral surface 27*a* of the adjacent speaker housing 27. When these procedures are repeated for all the speaker housings 27 and the pentagonal plate 28, the speaker housing assembly 26 is obtained. It goes without saying that there are provided pins and holes on the outer peripheral surface of the pentagonal plate 28.

By the way, although the pins 27*a*1 and the fit-in holes 27*a*2 are fitted with each other when combining the adjacent speaker housings 27, the fitting may be realized by any other suitable mechanism without limiting to the pins 27*a*1 and the holes 28*a*2, as far as the adjacent speaker housings 27 are positioned appropriately in relation to each other and combined firmly.

As illustrated in FIG. 10B, there is an air path in each vertex portion of the multifaced speaker housing assembly 26, the air path being created by combining three cut-out portions 27*f* that are each provided adjacent to the both ends of the outer peripheral surface 27*a* of the speaker housing 27, after the 12-faced speaker housing assembly 26 is assembled into a nearly spherical shell by combining the eleven speaker housings 27 and the one pentagonal plate 28. Through the air path, the air between the diaphragm 11 (FIGS. 4 through 9) and the multifaced speaker housing assembly 26 can flow inside the multifaced speaker housing assembly 26, which increases an amount of air inside the multifaced speaker housing assembly 26. Accordingly, a low-pitched resonant frequency fo shifts to lower frequencies, thereby providing an improved acoustic characteristic especially in the lower-pitched range of sound.

By the way, the first embodiment describes the air path formed in the multifaced speaker housing assembly 26, the air path being created by combining three cut-outs 27*f*, each being provided adjacent to the both ends of the three different speaker housings 27. However, at least one air path with an appropriate shape and position can be created in the multifaced speaker housing assembly 26, without limiting to the air path exemplified in the first embodiment.

In addition, in the speaker housing 27 in the first embodiment, the upper surfaces 27*b* are formed so that they make the speaker housing 27 look like a shape of substantially the same regular pentagon as the diaphragm segment 12, thereby providing an advantage of miniaturizing the speaker housing assembly 26. However, the upper surface of the speaker housing 27 may have a shape of polygon having more vertexes than the diaphragm segment 12, as far as the speaker housing can oppose the corresponding diaphragm segment after the multifaced speaker housing assembly is obtained.

By the way, the electroacoustic transducer 10A is assembled as follows. First, the constituting members such as the yoke 21, the magnet 22, the pole piece 23, the bobbin 24 having the voice coil 25 secured thereon, the first suspension 29, the spacer 30, and the second suspension 31 are assembled on the speaker housing 27 to obtain the speaker drive unit 20A. After the eleven speaker drive units 20A are obtained, the speaker drive units 20A are combined with one another by mating the outer peripheral surfaces 27*a* of the speaker housing 27 and by fitting the pins 27*a*1 into the fit-in holes 27*a*2. Then, the one pentagonal plate 28 (FIG. 10B) to be the bottom face is attached to the eleven speaker housings to obtain the multifaced speaker housing assembly 26. Next, the pipe member 15 (FIGS. 4 through 6) serving as a wire duct and a supporting member is secured to the one pentagonal plate 28 (FIG. 10B).

Then, the pipe member 15 (FIGS. 4 through 6) that is secured to the one pentagonal plate 28 is inserted into the through hole 13*a* of the pedestal 13 (FIG. 5) that opposes the one pentagonal plate 28 (FIG. 10B) in the multifaced speaker housing assembly 26. Next, an adhesive is applied to the one end portion 24*a* of each bobbin 24 in the eleven speaker drive units 20A and then the diaphragm 11 is placed, from above, so that the convex ring portion 12*b* of each diaphragm segment 12 is positioned on the one end portion 24*a* of each bobbin 24. As a result, the multifaced speaker housing assembly 26 that is similar to but smaller than the multifaced diaphragm assembly 11A is housed inside the multifaced diaphragm assembly 11A, and thus, the electroacoustic transducer 10A according to the first embodiment is finished.

By the way, the shape of the first and the second suspension 29, 31 that support the bobbin 24 in the speaker drive unit 20A vibratably in the direction of the central axis is specifically illustrated in FIG. 11.

As explained above, since the plurality of speaker drive units 20A are attached on the plurality of speaker housings 27 in the multifaced speaker housing assembly 26, any separate supporting member that has a polygonal shape and supports the plurality of the speaker drive units 20A is unnecessitated, thereby providing the electroacoustic transducer 10A according to the first embodiment at a lower cost.

Next, an acoustic characteristic of the electroacoustic transducer 10A will be described with reference to FIGS. 12 through 16.

Figure 12:
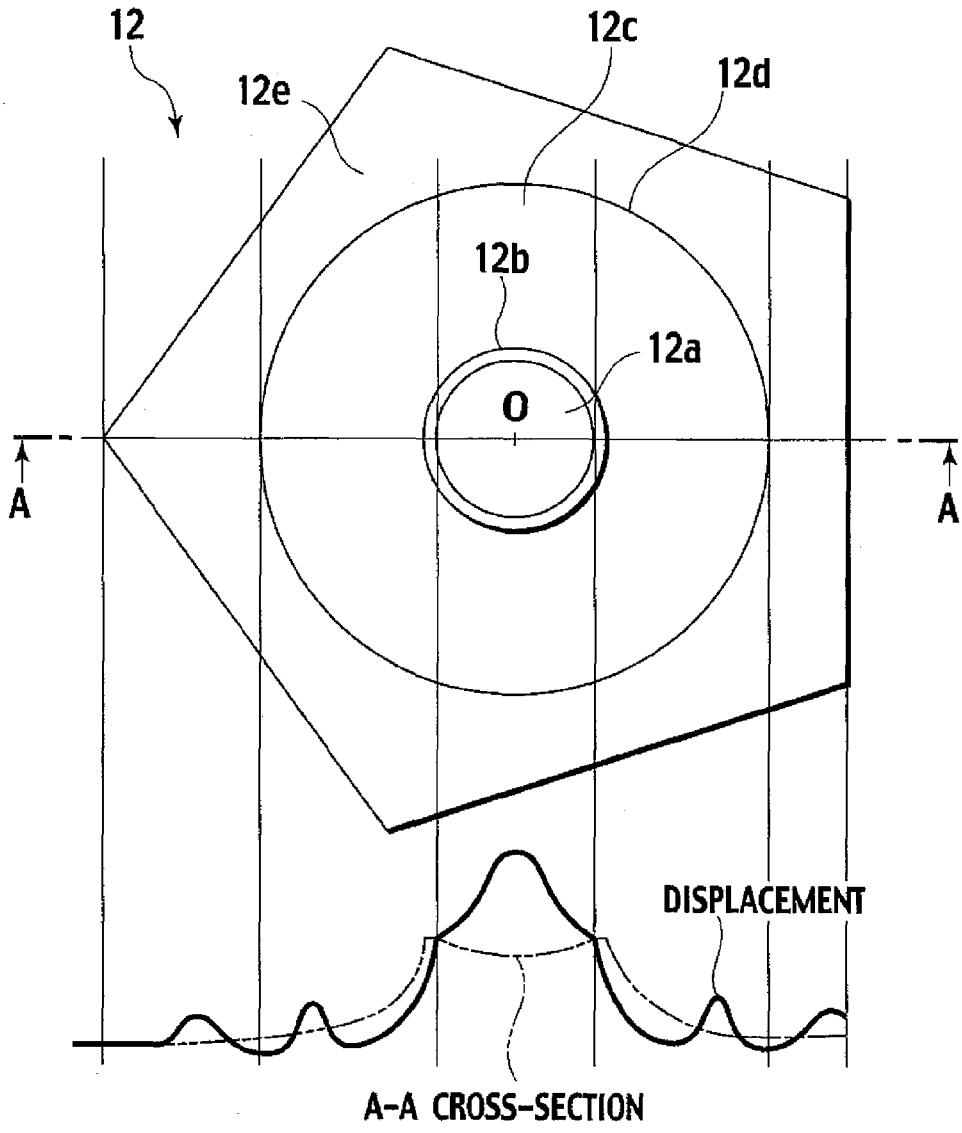
FIG. 12 illustrates a standing wave distribution on the diaphragm segment surface of the electroacoustic transducer according to the first embodiment in which a slope surface portion and a circle having relatively a large diameter are not eccentric.
Figure 13:
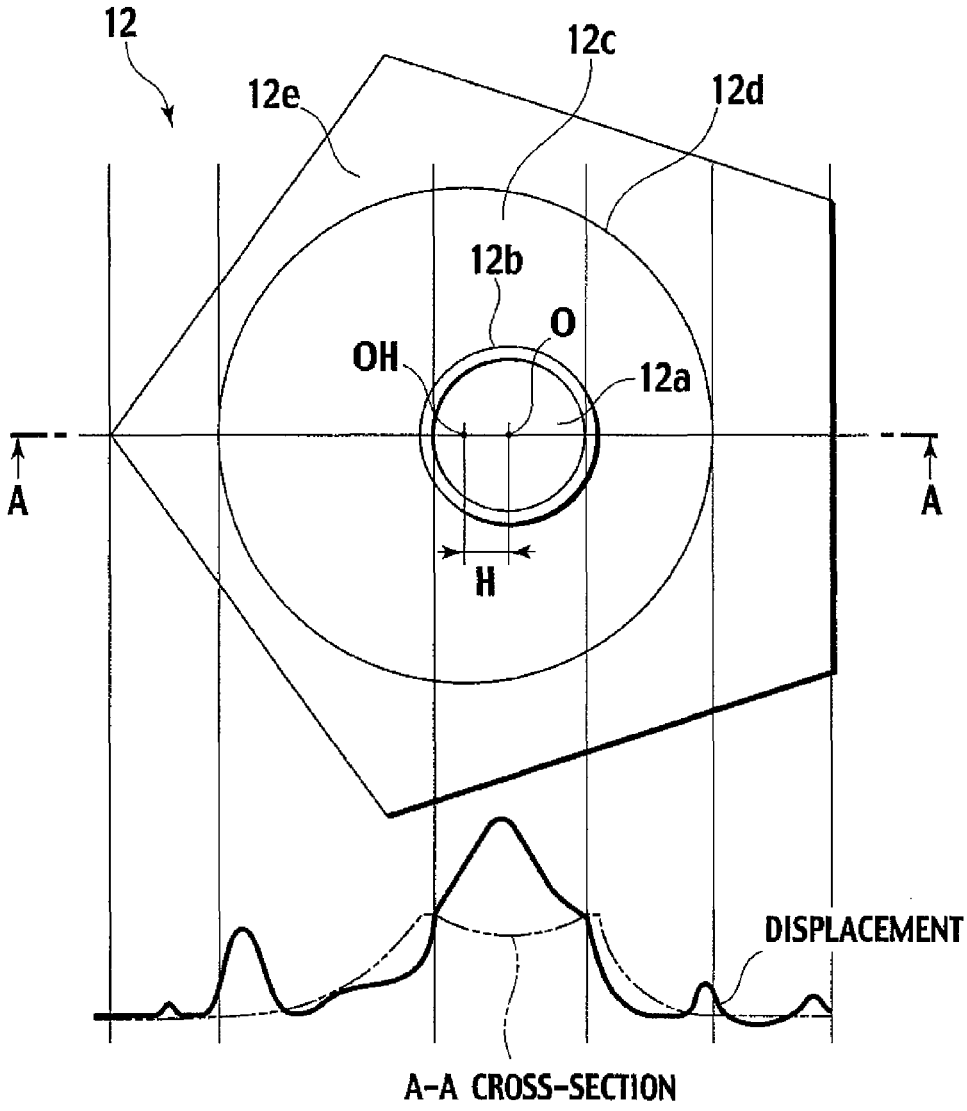
FIG. 13 illustrates a standing wave distribution on the diaphragm segment surface of the electroacoustic transducer according to the first embodiment in which a slope surface portion and a circle having relatively a large diameter are eccentric.

FIG. 12 illustrates a standing wave distribution on the diaphragm segment surface of the electroacoustic transducer according to the first embodiment of the present invention, in which the slope surface portion and the circle having relatively a large diameter are not eccentric. FIG. 13 illustrates a standing wave distribution on the diaphragm segment surface of the electroacoustic transducer according to the first embodiment of the present invention, in which the slope surface portion and the circle having relatively a large diameter are eccentric.

Figure 14:
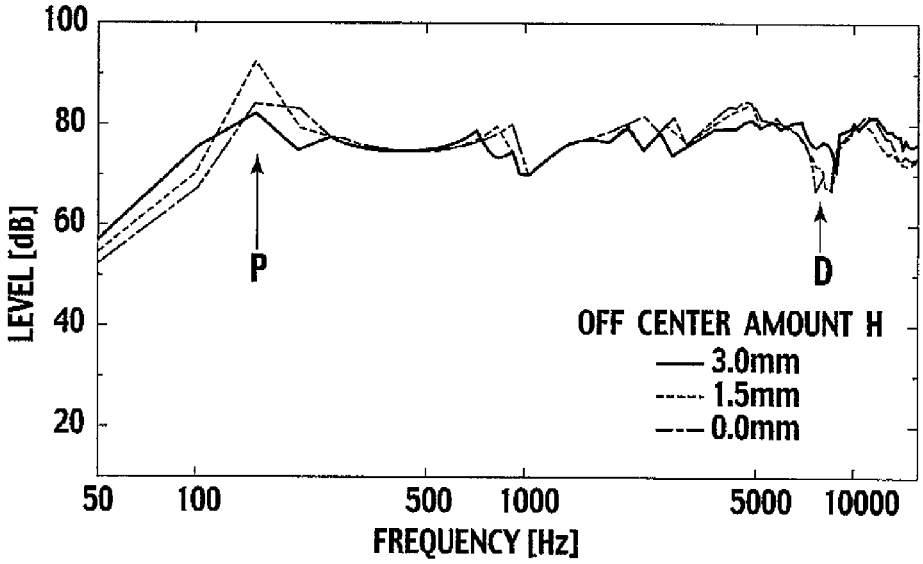
FIG. 14 illustrates a frequency response of sound reproduced by the diaphragm segment of the electroacoustic transducer according to the first embodiment of the present invention.
Figure 15:
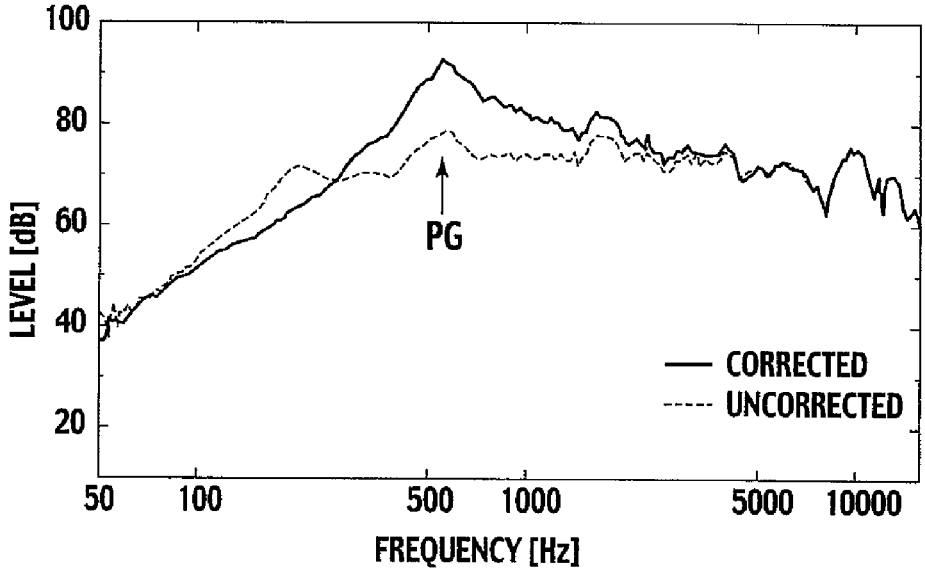
FIG. 15 illustrates a frequency response of synthetic sound produced by the electroacoustic transducer according to the first embodiment of the present invention.
Figure 16:
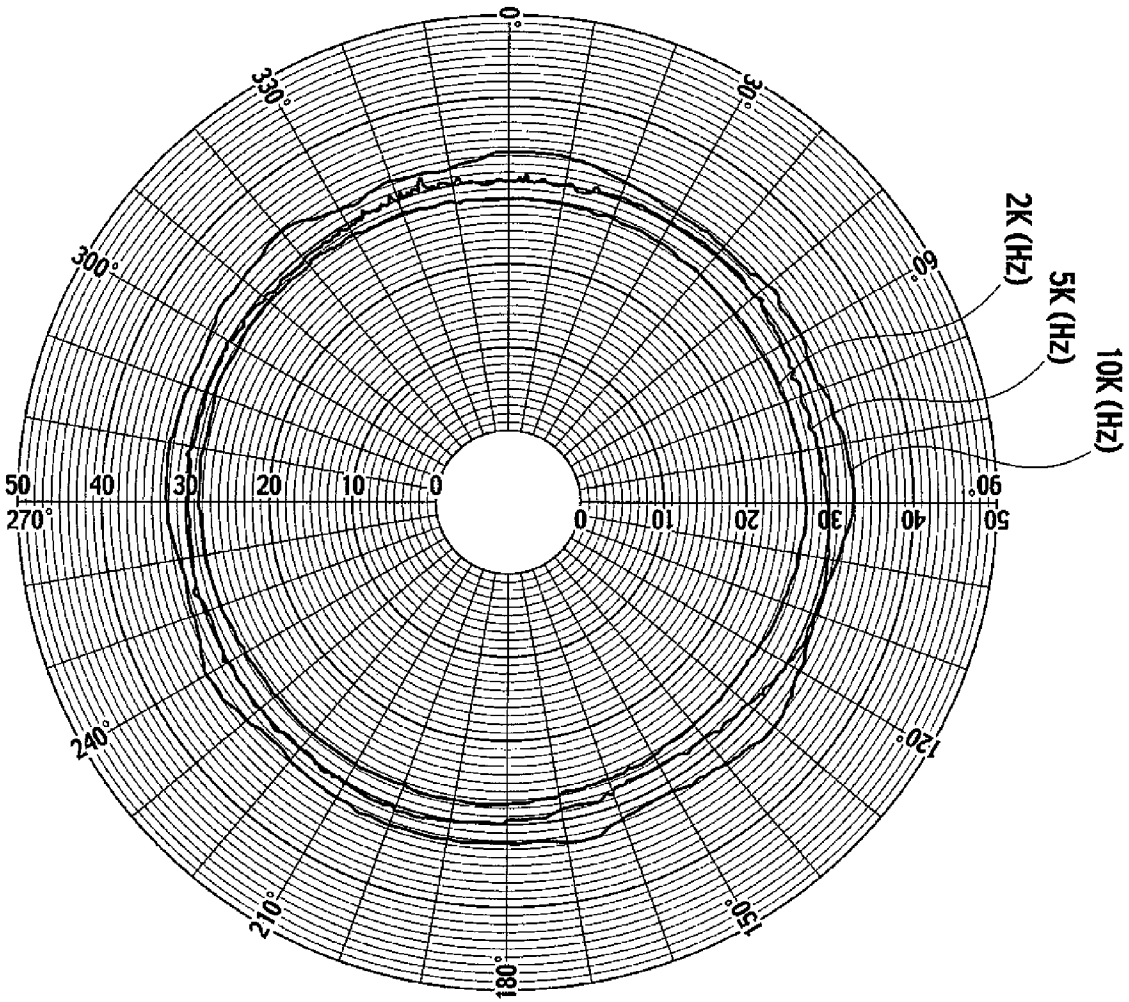
FIG. 16 illustrates a directivity of the electroacoustic transducer according to the first embodiment of the present invention.

FIG. 14 illustrates a frequency response of sound reproduced by the diaphragm segment in the electroacoustic transducer according to the first embodiment of the present invention. FIG. 15 illustrates a frequency response of synthetic sound produced by the electroacoustic transducer according to the first embodiment of the present invention. FIG. 16 illustrates a directivity of the electroacoustic transducer according to the first embodiment of the present invention.

FIGS. 12 and 13 illustrate the results of vibration analysis about vibration states of the diaphragm segment 12 when the slope surface portion 12*c* and the circle 12*d* having relatively a large diameter are not eccentric (FIG. 12) and when eccentric (FIG. 13). In the vibration analysis, it is assumed that force is applied to the voice coil 25 (FIG. 9) as a sine vibration of for example 12 kHz, the force being determined by a magnetic field intensity of the magnetic circuit, an effective length of the coil, and the number of turns of the coil. In FIGS. 12 and 13, a displacement distribution observed in the diaphragm segment 12 in the direction of the central axis is shown by a solid line, and an A-A cross-section of the diaphragm segment 12 is shown by a two-dot chain line.

As illustrated in FIG. 12, when the slope surface portion 12*c* and the circle 12*d* of the diaphragm segment 12 are not eccentric, it is apparent that the standing wave pattern is rotationally symmetric around the central axis O of the diaphragm segment 12. Therefore, synthetic reproduced sound obtained by mixing of sound from each diaphragm segment 12 is under a strong influence of the standing wave distribution.

On the other hand, as illustrated in FIG. 13, the slope surface portion 12*c* and the circle 12*d* of the diaphragm segment 12 are eccentric, it is apparent that the standing wave pattern in the diaphragm segment 12 is asymmetric around the central axis O of the diaphragm segment 12. Therefore, the synthetic reproduced sound is under less influence of the standing wave distribution, because a sound wave produced by a certain standing wave can be even out by a different sound wave produced by a different standing wave.

FIG. 14 illustrates a frequency response of synthetic reproduced sound by the diaphragm segment 12, in which it is assumed that a length of the edge of the regular pentagonal diaphragm segment 12 is for example 34 mm and an eccentric amount H (FIGS. 8 and 13) defined by the distance between the center of the slope surface portion 12*c* (or the circle 12*d*) of the diaphragm segment 12 and the central axis O is for example 0, 1.5 and 3 mm, the center being shifted toward one of the five vertices of the regular pentagon. As shown, as the eccentric amount H is increased, the level of the peak P appearing around a frequency of 150 Hz decreases, whereas the level of the dip D appearing around 8 kHz increases. Accordingly, the frequency response of the sound from each diaphragm segment 12 becomes flatter with an increase of the eccentric amount H, thereby providing better acoustic characteristic.

FIG. 15 illustrates a frequency response of reproduced sound by the electroacoustic transducer 10A obtained by combining the eleven diaphragm segments 12 into a nearly spherical shell, in which the eccentric amount H is set as 3 mm. While the peak frequency appears around 150 Hz in case of each diaphragm segment 12, though reduced by the effect of being eccentric, the peak frequency shifts to around 500 Hz (PG) in case of the electroacoustic transducer 10A. However, the peak around 500 Hz can be easily compensated by DSP (not shown) as shown by a dotted line.

As shown in FIG. 16, the electroacoustic transducer 10A obtained by combining the eleven diaphragm segments 12 into a nearly spherical shell has an omnidirectivity at a frequency of for example 2, 5, and 10 kHz, not only two-dimensionally but three-dimensionally, thereby providing an omnidirectional point source of sound like a pulsating sphere.

Next, application examples of the electroacoustic transducer 10A according to the first embodiment will be described with reference to FIGS. 17 and 18.

Figure 17:
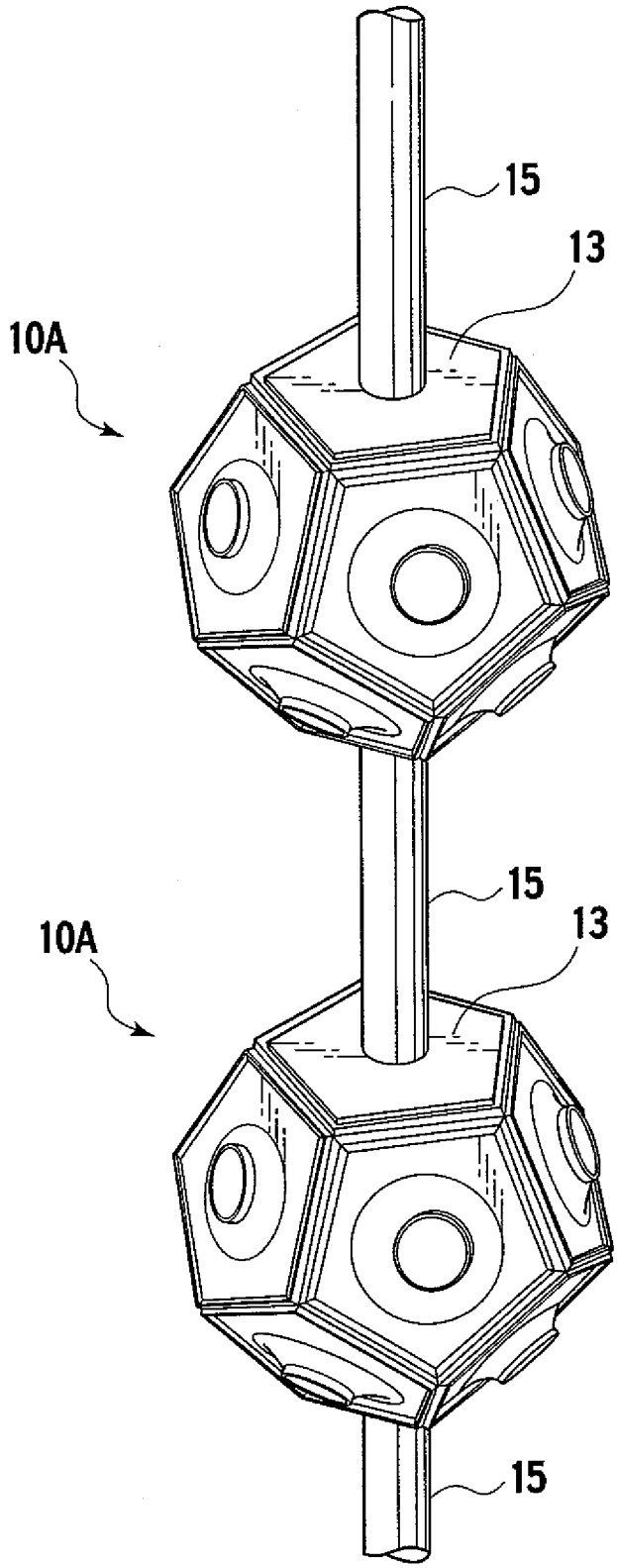
FIG. 17 is a perspective view of a first application example of the electroacoustic transducer according to the first embodiment of the present invention.

FIG. 17 is a perspective view of a first application example of the electroacoustic transducer according to the first embodiment of the present invention. FIG. 18 is a perspective view of a second application example of the electroacoustic transducer according to the first embodiment of the present invention.

As shown in FIG. 17, in the first application example of the electroacoustic transducer 10A according to the first embodiment of the present invention, the diaphragm segment 12 is not provided on the top face of the electroacoustic transducer 10A having twelve faces and instead an additional regular pentagonal pedestal 13 having the same outer shape of the diaphragm segment 12 is provide on the top face, in addition to the bottom face. Then, the pipe member 15 serving as a wire duct and a supporting member is attached on both pedestals 13, thereby providing a plurality of electroacoustic transducers 10A connected in series.

While each pipe member 15 is attached to each pedestal 13, one end portion of the pipe member 15 is supported by the pentagonal plate (supporting plate) 28 (FIG. 10B) that has substantially the same outer shape of the speaker housing 27 and constitutes the multifaced speaker housing assembly 26 along with the speaker housings 27.

Figure 18:
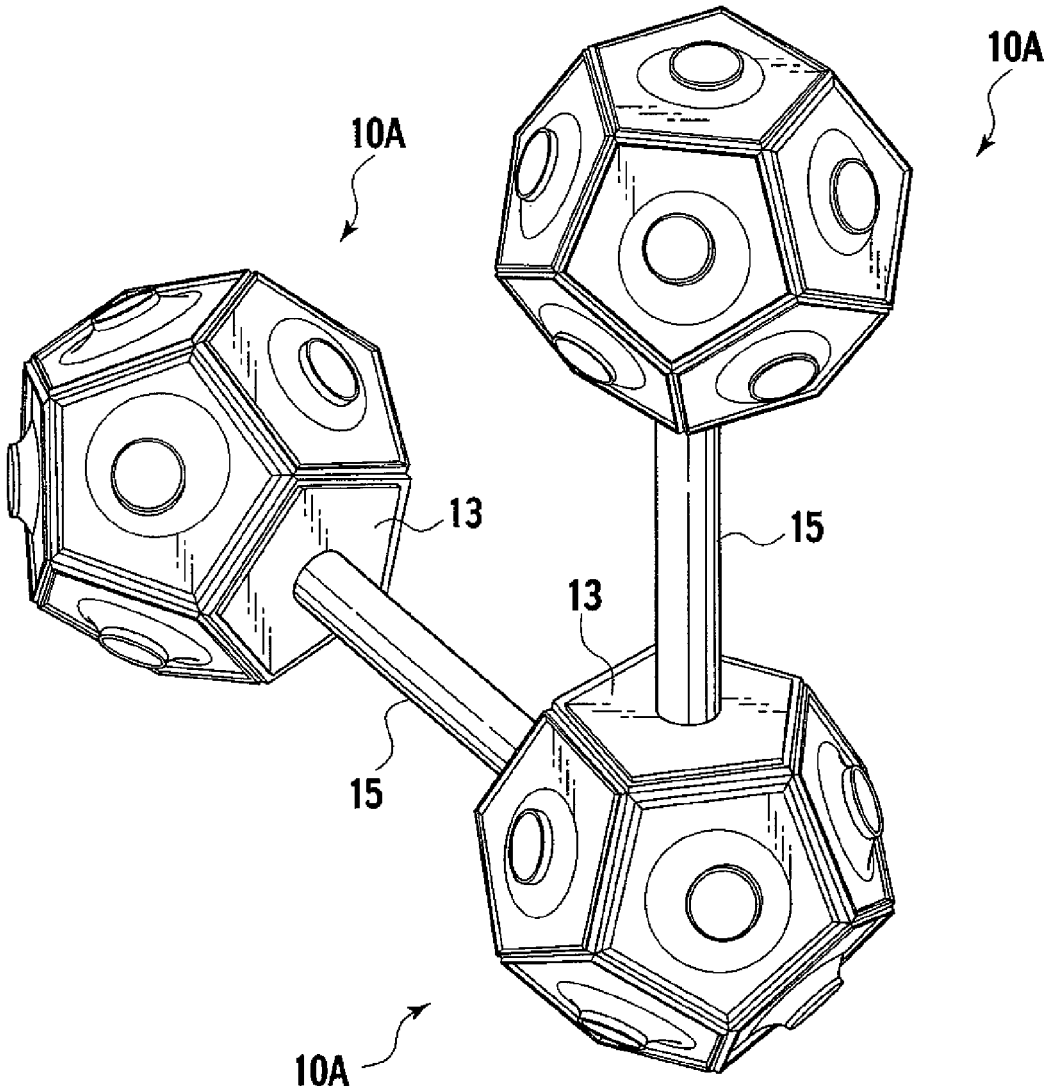
FIG. 18 is a perspective view of a second application example of the electroacoustic transducer according to the first embodiment of the present invention.

In addition, as illustrated in FIG. 18, in the second application example of the electroacoustic transducer 10A according to the first embodiment of the present invention, there can be provide a pedestal 13 instead of the diaphragm segment on at least two particular faces of the twelve-faced electroacoustic transducer 10A. Then, when the pipe member 15 is attached to the pedestals 13, a plurality of electroacoustic transducers 10A can be connected in an arbitrary direction.

(A Second Embodiment)

Figure 19:
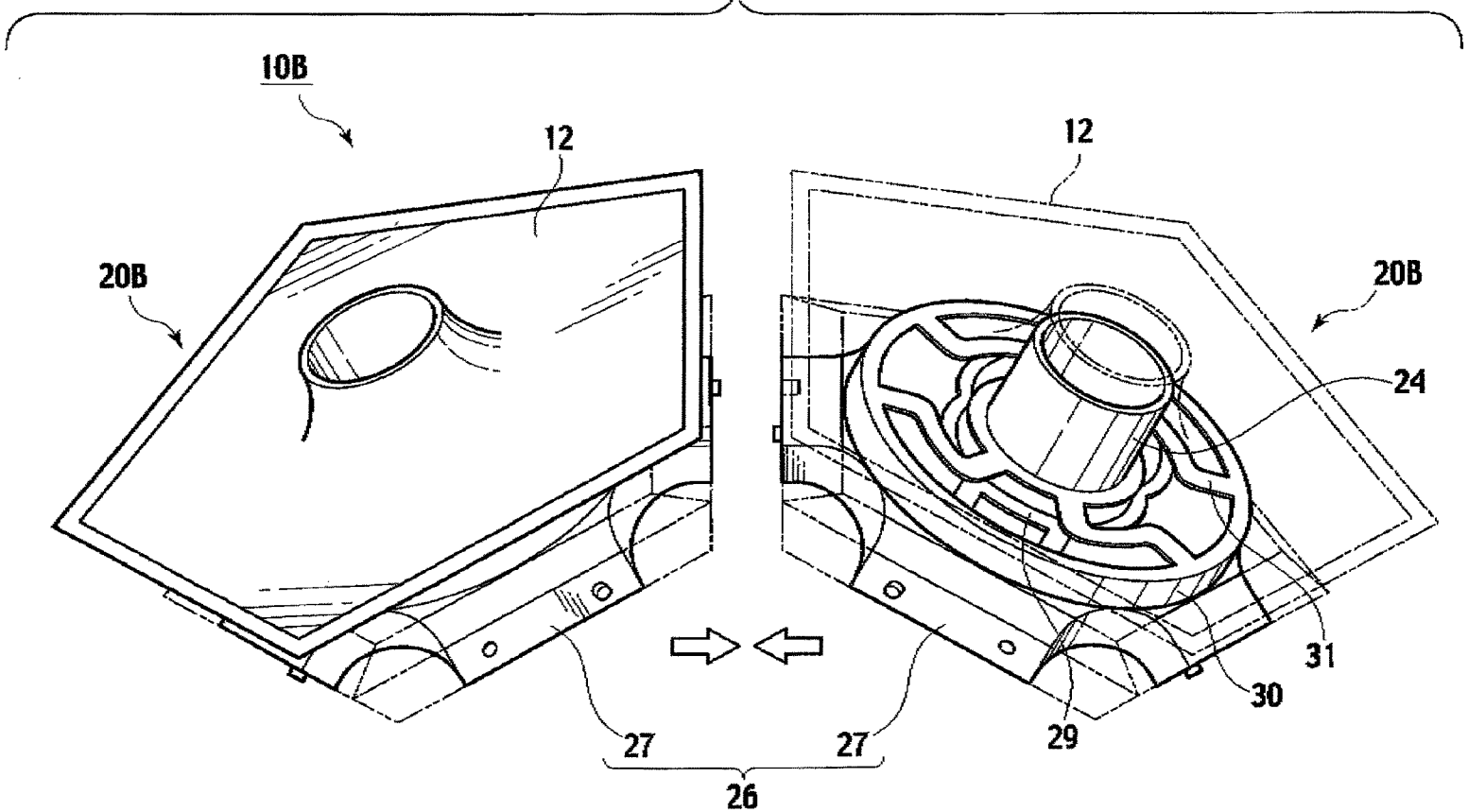
FIG. 19 is a perspective view outlining an electroacoustic transducer according to a second embodiment of the present invention.

FIG. 19 is a perspective view outlining an electroacoustic transducer according to a second embodiment.

An electroacoustic transducer 10B shown in FIG. 19 according to the second embodiment of the present invention has the same configuration as the electroacoustic transducer 10A according to the first embodiment described above, except a couple of portions. For the sake of simplicity, the following explanation will be centered on the different portions, with new reference marks given to new components and members, which are not used in the first embodiment, while the aforementioned components and members will be explained where necessary, with like reference marks given to like components and members.

As shown in FIG. 19, the electroacoustic transducer 10B according to the second embodiment is configured to provide an omnidirectional point source of sound like a pulsating sphere.

In the second embodiment, when the diaphragm 11 having the eleven diaphragm segments 12 is made, the eleven diaphragm segments 12 having for example a regular pentagon are prepared in a separate form, or without being attached with one another, which is different from the first embodiment. Then, after a speaker drive unit having the same configuration as the speaker drive unit according to the first embodiment is assembled using the speaker housing 27 as a base, each diaphragm segment 12 is adhered on the one end portion of a bobbin 24 of the speaker drive unit, thereby obtaining the eleven diaphragm-mounted speaker drive units 20B.

Then, the eleven speaker housings 27 and the one pentagonal plate 28 (FIG. 10B) are combined into a nearly spherical shell, thereby to obtain a twelve faced speaker housing assembly 26.

In addition, the eleven diaphragm segments 12 that are attached respectively to the diaphragm-mounted speaker drive units 20B are combined together into a nearly spherical shell so as to obtain the diaphragm 11. Then, the pedestal 13 (FIG. 5) having a shape of a regular pentagon is attached to the diaphragm 11 so as to take a shape of nearly spherical shell shape, thereby obtaining the twelve faced diaphragm assembly 11A.

By the way, when the eleven diaphragm segments 12 are combined to obtain the diaphragm 11 having a shape of a nearly spherical shell, the edge members 14 (FIGS. 4 and 5) are used to combine all the edges of the diaphragm segments 12 to be combined, as easily analogized from the explanation done with reference to FIG. 7.

Accordingly, the electroacoustic transducer 10B according to the second embodiment has the same construction and the same acoustic characteristic as the electroacoustic transducer 10A described with reference to FIGS. 4 through 6, thereby providing an omnidirectional point source of sound. In addition, productivity for the electroacoustic transducer 10B is increased by preparing the diaphragm-mounted speaker drive units 20B. Also, the multifaced speaker housing assembly 26 is able to eliminate the necessity of a separate multifaced supporting member for attaching therein the plurality of the diaphragm-mounted speaker drive units 20B, thereby providing the electroacoustic transducer 10B at a lower cost.

Moreover, although detailed explanation is omitted here, when a plurality of the electroacoustic transducers 10B are prepared, they can be connected with the pipe members 15 in the same way as described as the application examples 1, 2 referring to FIGS. 17 and 18.

(A Third Embodiment)

Figure 20:
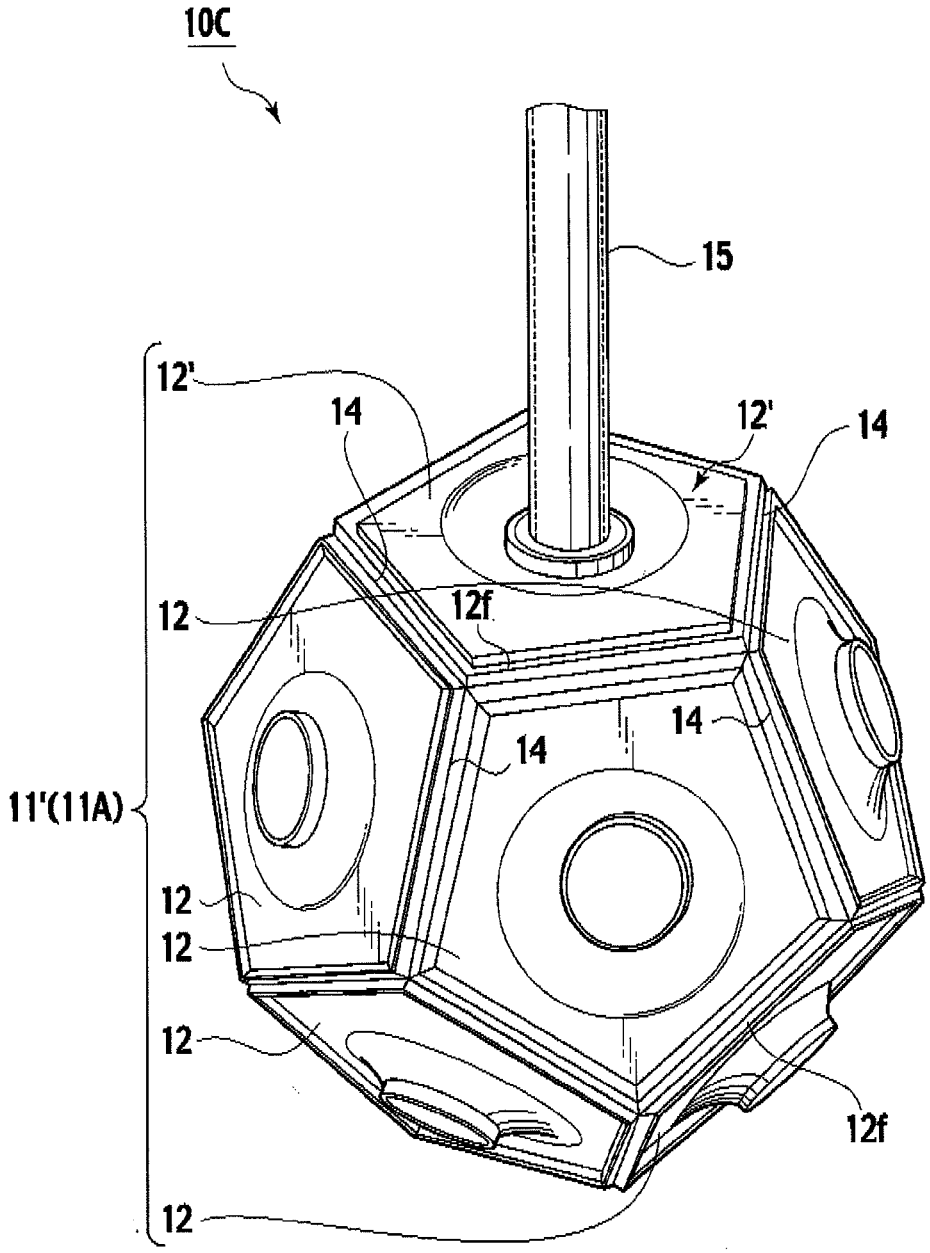
FIG. 20 is a perspective view of an electroacoustic transducer according to a third embodiment of the present invention, seen obliquely from its bottom.
Figure 21:
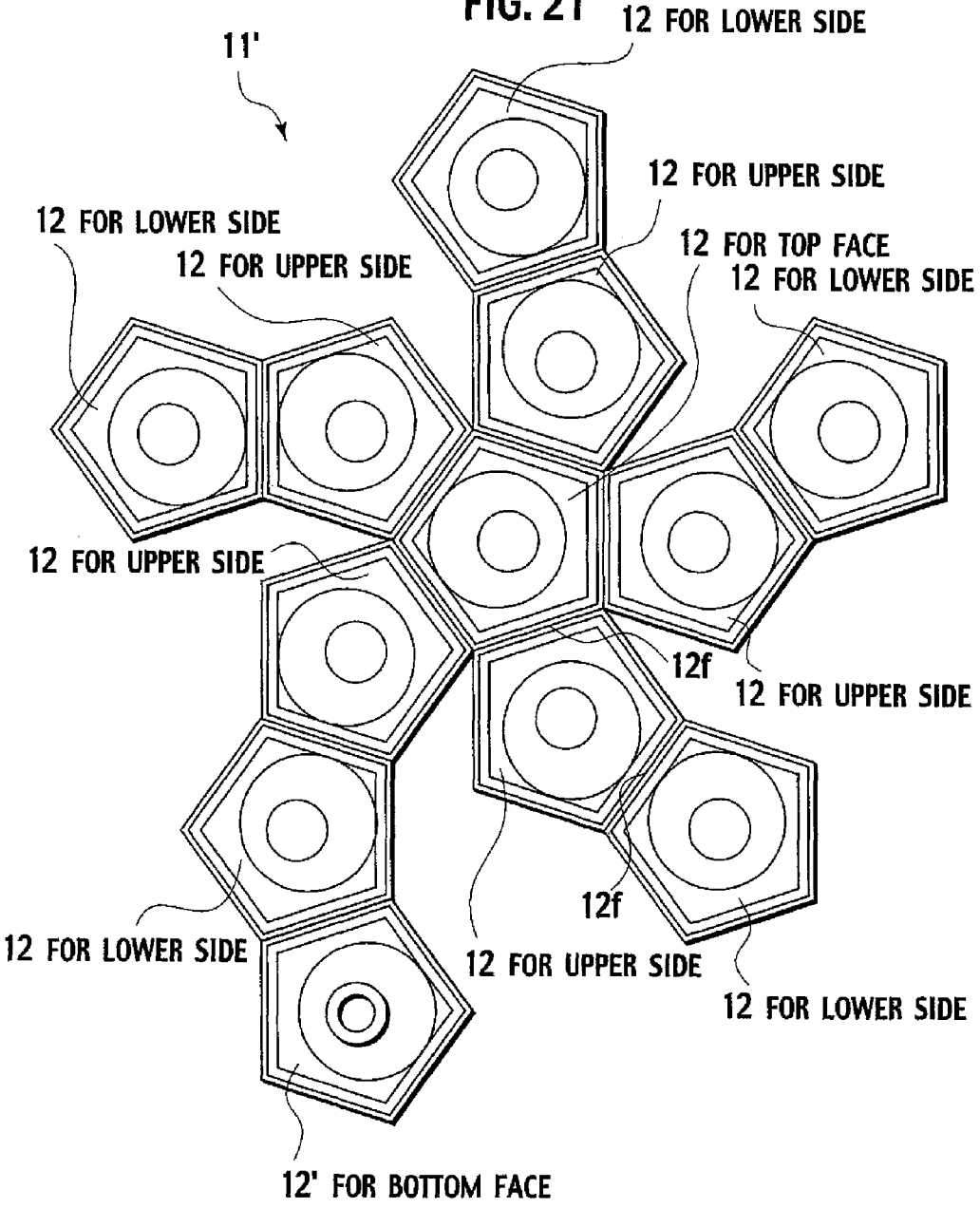
FIG. 21 a plane view showing a planar layout of a diaphragm to be obtained by combining 12 regular pentagonal diaphragm segments, in the electroacoustic transducer according to the third embodiment of the present invention.
Figure 22:
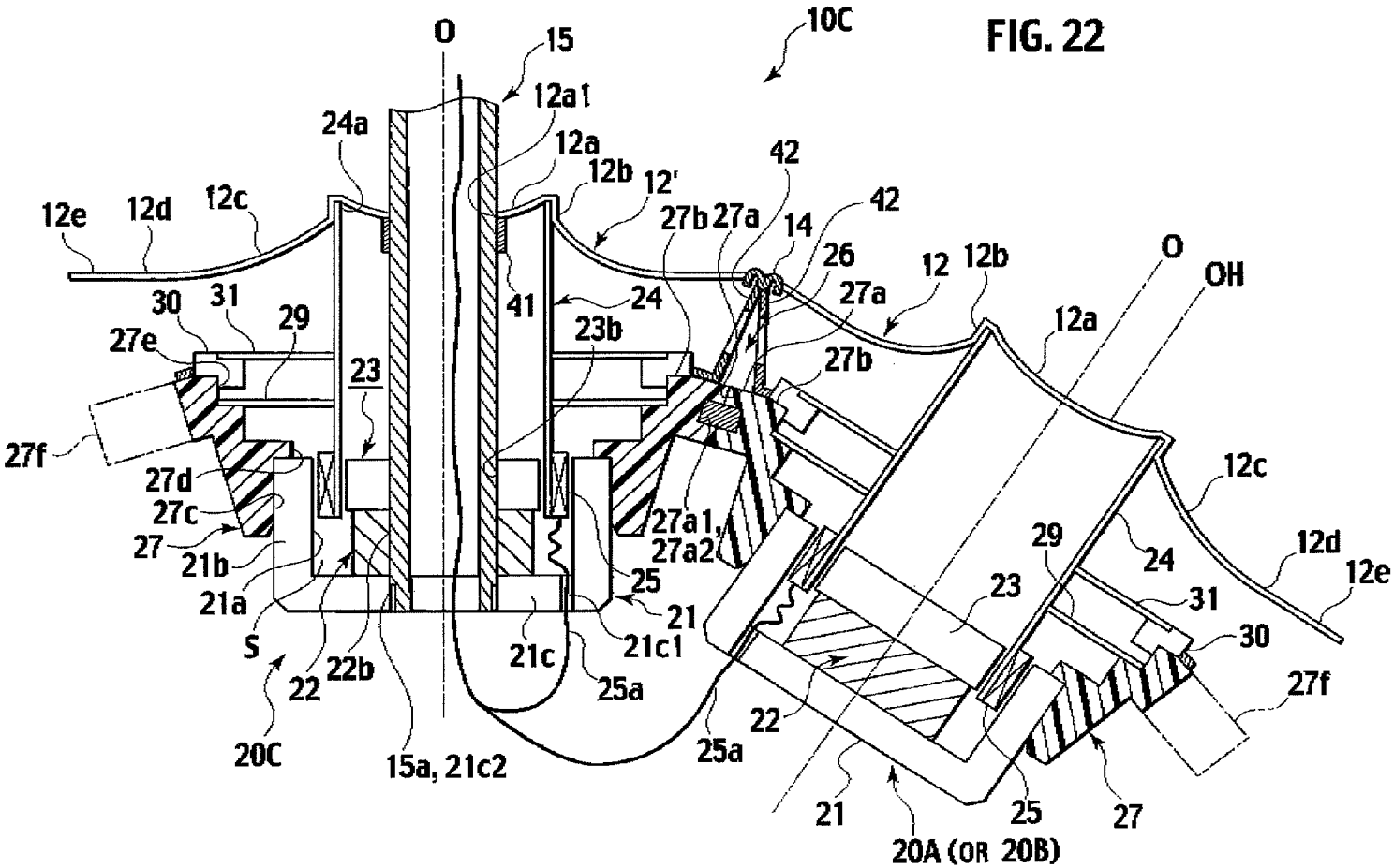
FIG. 22 is a partial cross-sectional view of the electroacoustic transducer according to the third embodiment, for purposes of explanation.
Figure 23A:
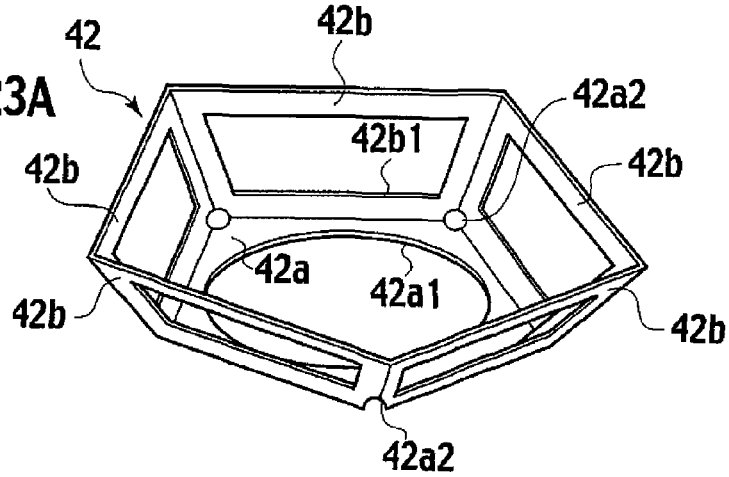
FIGS. 23A through 23C are a perspective view of a diaphragm connecting member that is used, where appropriate, to combine each inner edge of a diaphragm to a speaker housing in the electroacoustic transducer according to the third embodiment of the present invention.
Figure 23B:
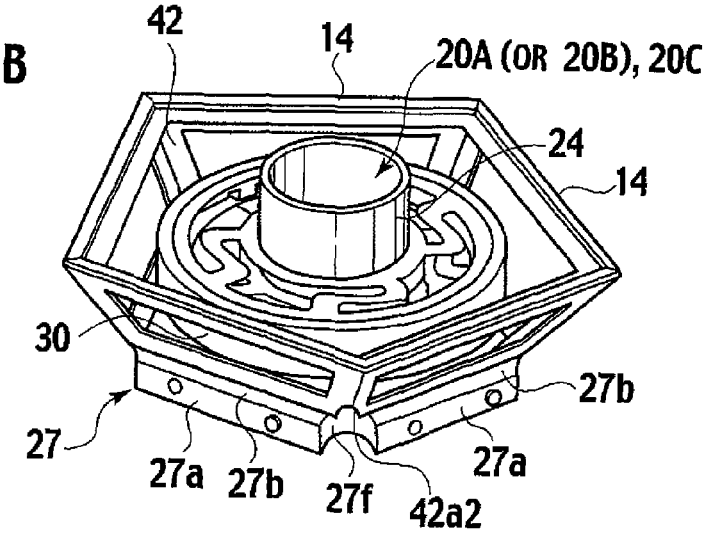
Figure 23C:
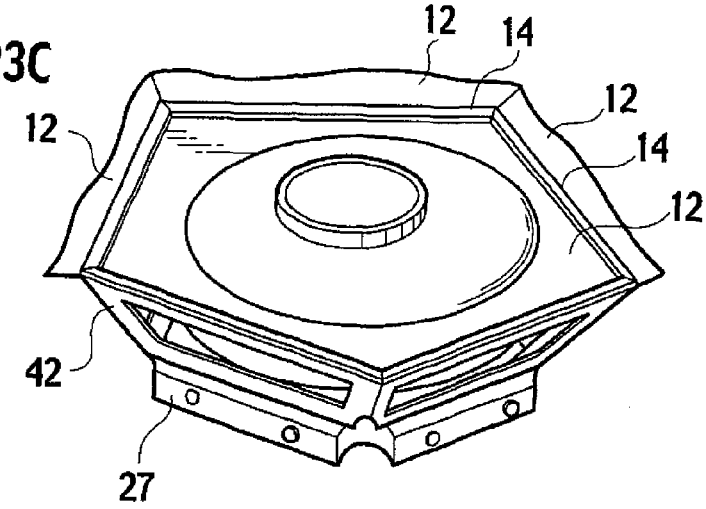

FIG. 20 is a partial cross-sectional view of an electroacoustic transducer according to a third embodiment of the present invention, for purposes of explanation. FIG. 21 illustrates a planar layout of twelve regular pentagonal diaphragm segments of the electroacoustic transducer according to the third embodiment of the present invention. FIG. 22 is a perspective view of the electroacoustic transducer according to the third embodiment of the present invention, seen from the bottom, including a partial broken view. FIGS. 23A through 23C are a perspective view of a diaphragm connecting member that is used, where appropriate, to combine each inner edge of the diaphragm to a speaker housing in the electroacoustic transducer according to the third embodiment of the present invention.

An electroacoustic transducer 10C according to the third embodiment of the present invention shown in FIG. 20 has the same configuration as the electroacoustic transducers 10A, 10B according to the first and the second embodiment, respectively, except a couple of portions. For the sake of simplicity, the following explanation will be centered on the different portions, with new reference marks given to new components and members, which are not used in the first and the second embodiment, while the aforementioned components and members will be explained where necessary, with like reference marks given to like components and members.

As shown in FIG. 20, the electroacoustic transducer 10C according to the third embodiment of the present invention is different from the first and the second embodiment in that there is prepared one pentagonal diaphragm segment 12' into which a pipe member serving as a wire duct and a supporting member for the transducer 10C can be inserted, instead of the pedestal 13 (FIG. 13), in a portion of the electroacoustic transducer 10C that is to be the bottom face. The eleven diaphragm segments 12 and the one diaphragm segment 12' are combined to be a diaphragm 11' as shown in FIG. 21 and the diaphragm 11' is assembled into a nearly spherical shell by combining the edges of the neighboring diaphragm segments 12, 12' using a plurality of edge portions 12*f* and edge members 14. This is how a twelve faced diaphragm assembly 11A' is obtained.

By the way, the multifaced diaphragm assembly 11A' may be assembled either by combining in advance the eleven diaphragm segments 12 and the one diaphragm segment 12' to be the bottom face as shown in FIG. 21, or by combining the eleven diaphragm segments 12 and the one diaphragm segment 12' to be the bottom face respectively to the twelve diaphragm-mounted speaker drive units 20B and one diaphragm-mounted speaker drive unit 20C (described later) in advance and then by combining the twelve diaphragm segments 12, 12'.

By the way, as shown in FIG. 22, in order to attach the pipe member 15 serving as a wire duct and a supporting member for the electroacoustic transducer 10C to the portion to be the bottom face of the electroacoustic transducer 10C, there is provided in the concave surface portion 12*a* of the one diaphragm segment 12' a through hole 12*a*1 for the pipe member to be inserted into, wherein the center of the through hole 12*a*1 coincides with the central axis O and the diameter of the through hole 12*a*1 is substantially the same as the outer diameter of the pipe member 15.

The pipe member 15 is made from non-magnetic materials such as but not limited to aluminum, resin or the like, since the pipe member 15 has to be inserted through the one diaphragm segment 12' into the one speaker drive unit 20C to which the one diaphragm segment 12' is attached.

In addition, a cylindrical buffer member 41 formed of felt or fabric is adhered along the inner circumference of the through hole 12*a*1 for the pipe member 15 to be inserted into, the through hole 12*a*1 being provided in the concave surface portion 12*a* of the one diaphragm segment 12'. The cylindrical buffer member 41 is vibratable in the direction of the central axis along with the diaphragm segment 12'. The cylindrical buffer member 41 is provided in order to prevent air from leaking through a gap between the pipe member 15 and the through hole 12*a*1 from the inside of the diaphragm segment 12', when the pipe member 15 is inserted into the through hole 12*a*1.

In the electroacoustic transducer 10C according to the third embodiment, the eleven speaker drive units 20A (or 20B) described in the first embodiment (or the second embodiment) are attached concentrically with one another so as to oppose respectively the eleven diaphragm segments 12 from inside. In addition, there is attached the one speaker drive unit 20C, which has a slightly different configuration from the eleven speaker drive units 20A (or 20B), behind the one diaphragm segment 12' in such a way that the center axis of the one speaker drive unit 20C coincides with that of the one diaphragm segment 12'. Here, the one diaphragm segment 12' is also vibratable by the one speaker drive unit 20C, like the other eleven diaphragm segments 12.

The eleven speaker housings 27 having respectively the eleven speaker drive units 20A (or 20B) and the one speaker housing 27 having the one speaker drive unit 20C are combined together into a nearly spherical shell, thereby obtaining the twelve faced speaker housing assembly 26, as is the case with the first and the second embodiment.

When it comes to constituting members of the one speaker drive unit 20C, the yoke 21, the magnet 22, and the pole piece 23, which have been used in the speaker drive units 20A (or 20B), are partially modified in order to attach the pipe member 15 therein.

Specifically, among the constituting members of the one speaker drive unit 20C, the yoke 21 has a screw hole 21*c*2 that penetrates through the bottom face 21*c* in such a way that the center axis of the screw hole 21*c*2 coincides with the central axis O of the diaphragm segment 12', the screw hole 21*c*2 allowing a screw portion 15*a* formed in one end portion of the pipe member 15 to be screwed thereinto.

In addition, the magnet 22 and the pole piece 23 have through holes 22*b*, 23*b*, respectively, that penetrate therethrough to allow the pipe member 15 to be inserted through. The through holes 22*b*, 23*b* are formed so that the center axis thereof coincides with the central axis O and the diameter thereof is substantially the same as the outer diameter of the pipe member 15.

With the above modification, the pipe member 15 is secured to the yoke 21 as follows. First, the pipe member 15 is inserted through the through hole 12*a*1 formed in the concave surface portion 12*a* of the one diaphragm segment 12' opposing the bottom face of the electroacoustic transducer 10C. Then, the inserting end (with the screw portion 15*a*) of the pipe member 15 goes through the magnet 22 to reach the yoke 21. Next, the screw portion 15*a* of the pipe member 15 is screwed into the screw hole 21*c*2 of the yoke 21. Then, after the pipe member 15 is secured to the yoke 21, the lead wires 25*a* from the plurality of voice coils 25 are led out through the pipe member 15.

As described above, according to the diaphragm 11' in the third embodiment, the one diaphragm segment 12' in addition to the eleven diaphragm segments 12 can vibrate, that is, the total of the twelve diaphragm segments 12, 12' can vibrate, thereby providing a better acoustic characteristic than the diaphragm 11 in the first and the second embodiment.

By the way, although there has been described the pipe member 15 attached to the diaphragm segment 12' opposing the bottom face of the electroacoustic transducer 10C in the third embodiment, a plurality of the electroacoustic transducers 10C may be prepared and connected by a plurality of pipe members 15 serving as a wire duct and a supporting member, as described as the application examples 1, 2 of the first embodiment with reference to FIGS. 17 and 18. When a plurality of the electroacoustic transducers 10C are connected, the electroacoustic transducer 10C has to be configured so as to have at least two of the one speaker drive units 20C having the one diaphragm segments 12', which allows the appropriate numbers of the pipe members 15 to be inserted accordingly into the yoke 21 of the one speaker drive unit 20C.

In addition, in the electroacoustic transducer 10C according to the third embodiment of the present invention, there are provided a plurality of diaphragm connecting members 42, where necessary, between the edge portion of the diaphragm segment 12 (or 12') and the top surface 27*b* of the speaker housing 27 on which each speaker drive unit 20A (or 20B) (20C) opposing each diaphragm segment 12 (or 12') is attached, as shown in FIG. 22. The diaphragm connecting member 42 is useful in that it can prevent the diaphragm segment 12 (or 12') from deforming by the self-weight thereof especially when the multifaced diaphragm assembly 11A is relatively large or when each edge member 14 in the multifaced diaphragm assembly 11A' is made of a soft material.

The diaphragm connecting member 42 is preferably made of a flexible material having higher flexibility than each diaphragm segment 12 (or 12'), such as but not limited to polyurethane rubber, in order not to adversely affect the vibration of each diaphragm segment 12 (or 12) constituting the diaphragm 11'.

Specifically, as shown in FIGS. 23A through 23C, the diaphragm connecting member 42 has a pentagonal bottom face 42*a* that matches in terms of dimension the top face 27*b* of the speaker housing 27 formed into a pentagon. The bottom face 42*a* has a circular hole 42*a*1 that allows the ring-shaped spacer 30 attached on the top face 27*b* of the speaker housing 27 to go therethrough. In addition, the diaphragm connecting member 42 has an air path hole 42*a*2 at the vertex portion thereof the air path hole 42*a*2 opposing the cut-out portion 27*f* which is to create the air path of the speaker housing 27.

Additionally, the diaphragm connecting member 42 has five inclined surfaces 42*b* that each are inclined outward along the upward direction from the bottom face 42*a*. Each inclined surface 42*b* is connected one by one to form a pentagonal frame. Each inclined surface 42*b* also has a rectangular hole 42*b*1 that penetrates therethrough so that the diaphragm connecting member 42 does not have an excessive rigidity.

The bottom face 42*a* of the diaphragm connecting member 42 is adhered on the top surface 27*b* of the speaker housing 27 using an adhesive. Also, the upper end of each inclined surface 42*b* is adhered to the edge portion 12*f* (FIG. 21) of the diaphragm segment 12 (or 12') and the edge member 14 from inside, the edge portion 12*f* being where the neighboring edges are combined.

By the way, although the upper end of the diaphragm connecting member 42 can be adhered entirely to the diaphragm segment 12 (or 12'), only the center portion thereof or both end portion thereof may be adhered to the diaphragm segment 12 (or 12') so that the diaphragm connecting member 42 supports partially the diaphragm segment 12 (or 12').

As described above, in the multifaced diaphragm assembly 11A' having a shape of a nearly spherical shell obtained by combining the total of the twelve diaphragm segments 12, 12', since the diaphragm segment 12, 12' is supported from inside by the diaphragm connecting member 42, each diaphragm segment 12, 12' is prevented from deforming by its own weight, thereby providing a better acoustic characteristic.

By the way, the technical idea that the diaphragm segment 12, 12' is supported from inside by the diaphragm connecting member 42 is applicable to the multifaced diaphragm assembly 11A (FIGS. 4 through 6) obtained by combining the eleven diaphragm segments 12 into the diaphragm 11 having a nearly spherical shell in the first and the second embodiment.

(A Fourth Embodiment)

Figure 24:
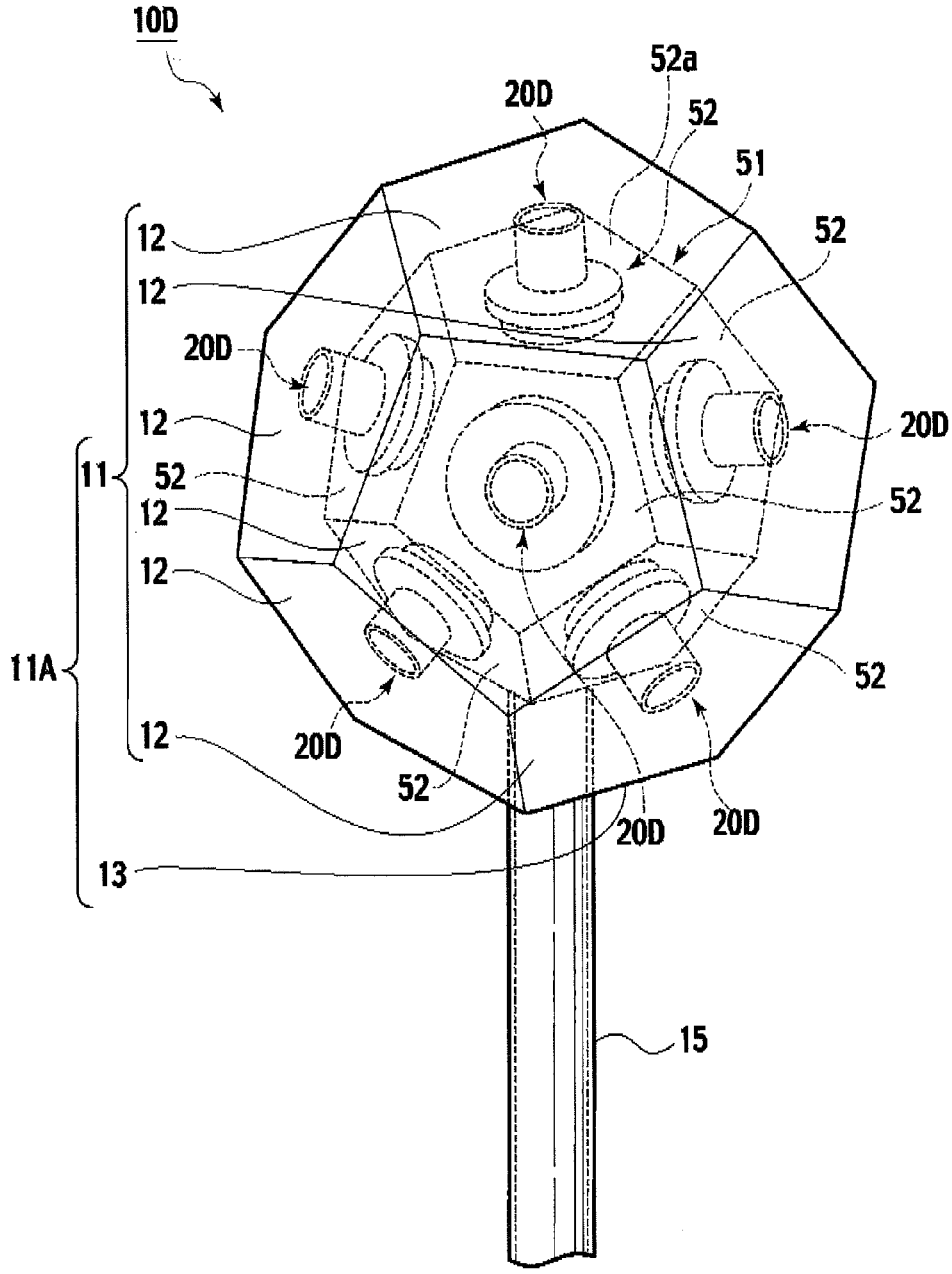
FIG. 24 is a schematic perspective view of an electroacoustic transducer according to a forth embodiment of the present invention.
Figure 25:
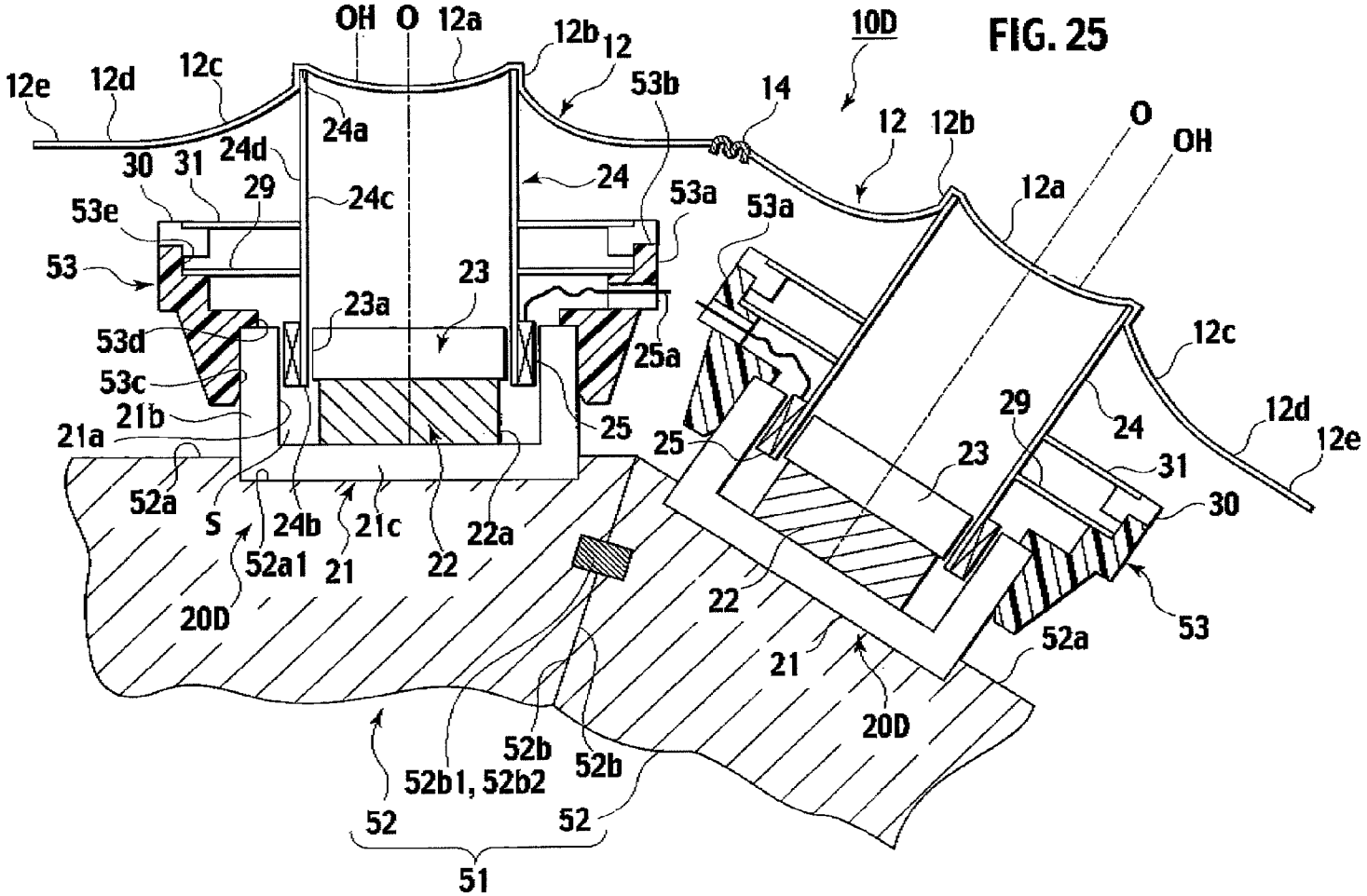
FIG. 25 is a partial cross-sectional view illustrating that adjacent two speaker units are assembled, in the electroacoustic transducer according to a forth embodiment of the present invention.
Figure 26A:
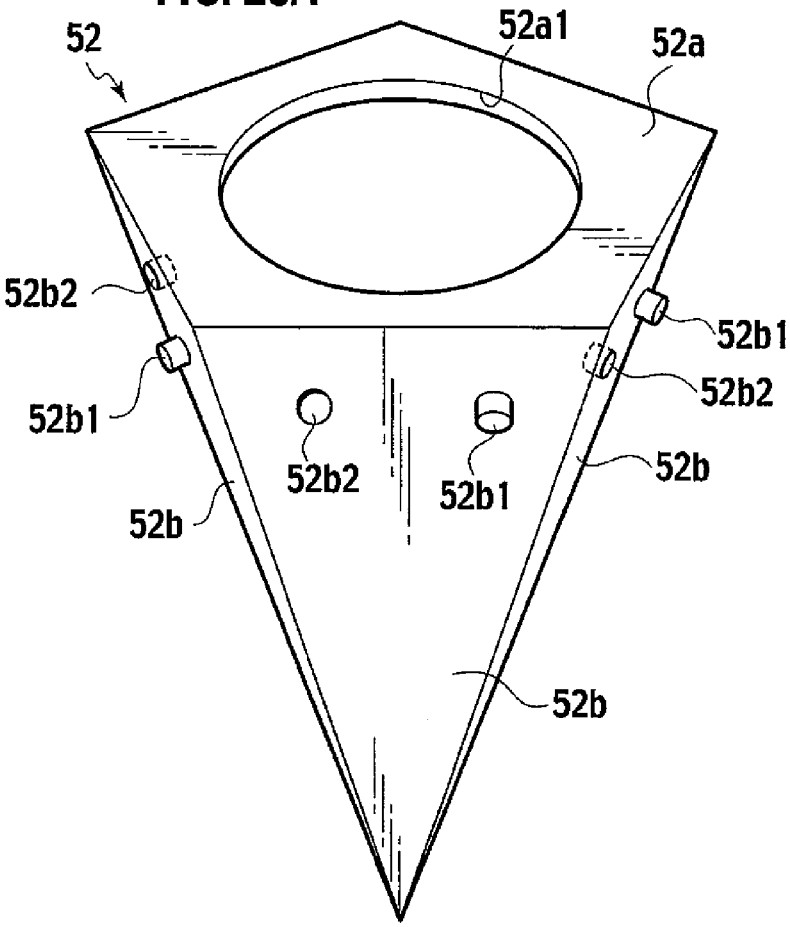
FIG. 26A is an enlarged perspective view of a pentagonal pyramid of a multifaced mounting pedestal assembly.
Figure 26B:
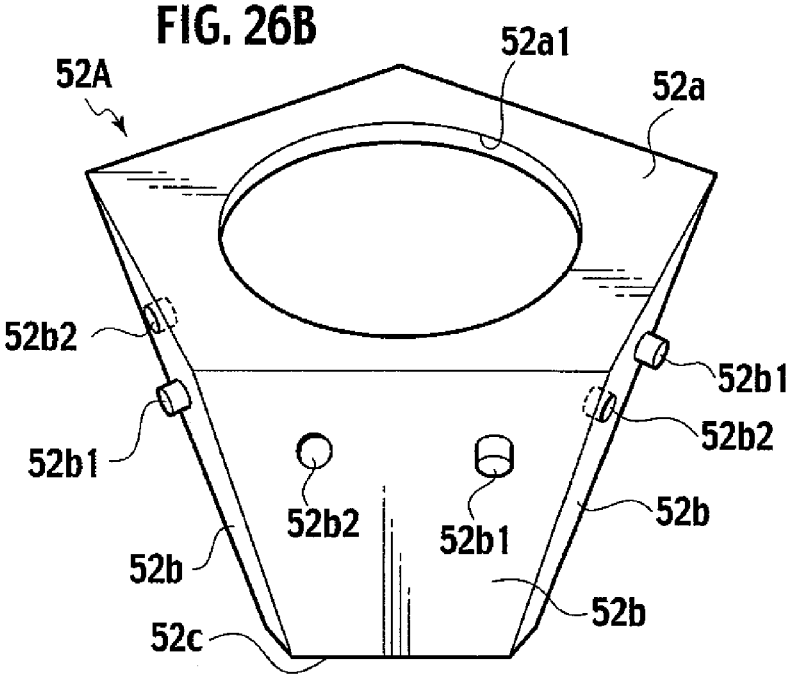
FIG. 26B is an enlarged perspective view of a pentagonal pyramid pedestal of a multifaced mounting pedestal assembly.
Figure 27:
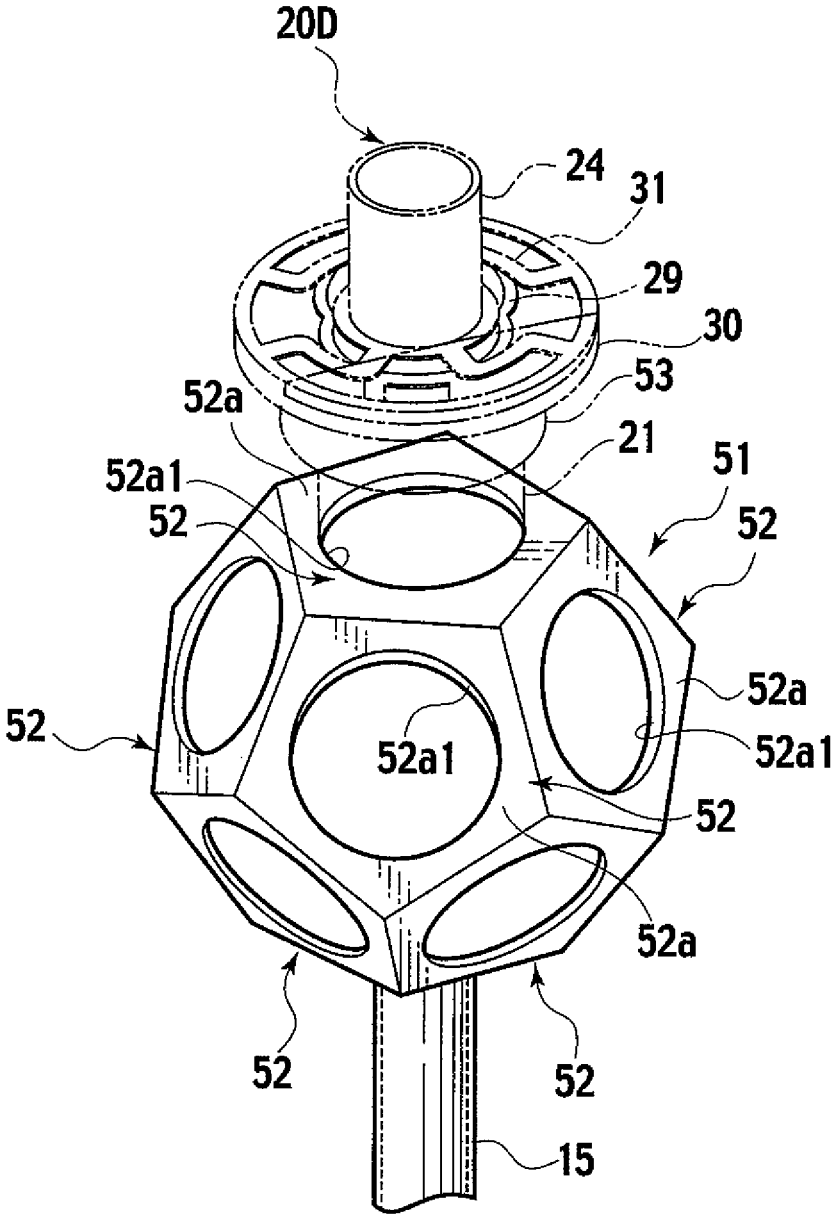
FIG. 27 is a perspective view of the multifaced mounting pedestal assembly obtained by assembling a plurality of pentagonal pyramids.

FIG. 24 is a perspective view outlining an electroacoustic transducer according to a forth embodiment of the present invention. FIG. 25 is an enlarged vertical cross-sectional view illustrating that adjacent two speaker units are assembled, in the fourth embodiment of the present invention. FIG. 26A is an enlarged perspective view illustrating a pentagonal pyramid of a multifaced mounting pedestal assembly of the electroacoustic transducer of the present invention. FIG. 26B is an enlarged perspective view illustrating a pentagonal pyramid pedestal of a multifaced mounting pedestal assembly of the electroacoustic transducer of the present invention. FIG. 27 is a perspective view of the multifaced mounting pedestal assembly obtained by assembling a plurality of pentagonal pyramids.

An electroacoustic transducer 10D according to the fourth embodiment of the present invention shown in FIG. 24 has the same configuration as the electroacoustic transducer 10A according to the first embodiment, except a couple of portions. For the sake of simplicity, the following explanation will be centered on the different portions, with new reference marks given to new components and members, which are not used in the first embodiment, while the aforementioned components and members will be explained where necessary, with like reference marks given to like components and members.

The electroacoustic transducer 10D according to the fourth embodiment of the present invention shown in FIG. 24 is configured in such a way that the twelve-faced diaphragm assembly 11A is obtained by combining the diaphragm 11 formed by combining the eleven regular pentagonal diaphragm segments 12 as shown in advance in FIG. 7 and the regular pentagonal pedestal 13 (FIG. 5) to be the bottom face of the diaphragm 11 having a certain rigidity, and then the pipe member 15 serving as a wire duct and a supporting member is attached in the center portion of the pedestal 13.

Therefore, the electroacoustic transducer 10D according to the fourth embodiment is configured so as to provide an omnidirectional point source of sound like a pulsating sphere, with the same configuration as the electroacoustic transducer 10A according to the first embodiment explained in advance with reference to FIGS. 4, 5. However, the inner construction of the multifaced diaphragm assembly 11A that is formed into a nearly spherical shell having twelve faces is different from that of the first embodiment.

Namely, in case of the electroacoustic transducer 10D according to the fourth embodiment of the present invention, a twelve faced mounting pedestal assembly 51 that is similar to but smaller in dimension than the multifaced diaphragm assembly 11A is housed in the multifaced diaphragm assembly 11A that is formed into a nearly spherical shape having twelve surfaces. The multifaced mounting pedestal assembly 51 is obtained by combining eleven speaker mounting pedestals (referred to as a pentagonal pyramid, hereinafter) 52 and one supporting pedestal (referred to one pentagonal pyramid, hereinafter) 52 to be the bottom face thereof into a nearly spherical shape. Each pentagonal pyramid 52 having been formed into a shape of a pentagonal pyramid is formed so as to have a speaker drive unit 20D attached thereon.

As shown in FIG. 25, adjacent two diaphragm segments 12 in the diaphragm 11 are combined using the edge member 14 where necessary, and the pedestal 13 (FIG. 5) is combined to the neighboring diaphragm segments 12 using the edge member 14.

The speaker drive unit 20D that opposes and vibrates the diaphragm segment 12 is composed of the following constituting members (described later) and is assembled concentrically in relation to the central axis O of the diaphragm segment 12. By the way, the diaphragm segment 12 is adhered to the one end portion 24*a* of the bobbin 24 (described later) positioned in the center portion of the inner surface of the diaphragm segment 12 after the speaker drive unit 20D is assembled. Therefore, the speaker drive unit 20D used in the fourth embodiment is a unit without any diaphragm.

The aforementioned speaker drive unit 20D is different from the first embodiment in that a speaker housing 53 serving as a base for the speaker drive unit 20D is separated from the neighboring speaker housing 53.

The aforementioned speaker housing 53 is formed of a non-magnetic resin so as to have a top face 53*b* that is formed into a ring shape and positioned in the inner upper portion in relation to an outer peripheral surface 53*a*, a lower circular concave portion 53*c* that is formed by hollowing and positioned in the inner lower portion thereof in such a way that the center axis of the lower circular concave portion 53*c* coincides with the central axis O of the diaphragm segment 12, a through hole 53*d* and an upper circular concave portion 53*e* that are formed concentrically and positioned above the lower circular concave portion 53*c*.

When the speaker drive unit 20D is assembled, the ring-shaped outer wall portion 21*b* of the yoke 21 is adhered with an adhesive in the lower circular concave portion 53*c* of the speaker housing 53, and the cylindrical magnet 22 and the cylindrical pole piece 23 are stacked in the circular concave portion 21*a* of the yoke 21 in such a way that the central axis thereof coincides with the central axis O of the diaphragm segment 12. In addition, with the voice coil 25 being adhered on the outer circumferential surface 24*d* near the other end portion 24*b* of the bobbin 24, the middle portion of the outer circumferential surface 24*d* of the bobbin 24 is supported vibratably by the first suspension 29 attached inside the upper circular concave portion 53*e* of the speaker housing 53 and the second suspension 31 attached through the ring-shaped spacer 30. Moreover, the inner circumferential surface 24*c* near the other end portion 24*b* of the bobbin 24 is arranged so as to oppose the outer circumferential surface 23*a* of the pole piece 23 leaving a slight gap therebetween.

By the way, in the fourth embodiment, the lead wire 25*a* of the voice coil 25 is led out by way of the outer peripheral surface 53*a* of the speaker housing 53.

In addition, after the speaker drive unit 20D is assembled, the one end portion 24*a* of the bobbin 24 is adhered using an adhesive to the inner surface of the convex ring portion 12*b* formed so as for the center thereof to coincide with the central axis O of the diaphragm segment 12.

In the speaker drive unit 20D assembled from each constituting member as described above, the yoke 21, the magnet 22, the pole piece 23, and the voice coil 25 attached on the outer circumferential surface 24*d* of the bobbin 24 create a magnetic circuit. When a drive current is fed to the voice coil 25, the magnetic circuit produces a driving force in the voice coil 25, thereby moving the bobbin 24 in the direction of the central axis O, the voice coil 25 being supported vibratably by the first and the second suspension 29, 31. Accordingly, the diaphragm segment 12 adhered on the one end portion 24*a* of the bobbin 24 vibrates to produce sound. When the eleven speaker drive units 20D are driven in unison, the eleven diaphragm segments 12 constituting the diaphragm 11 vibrate to produce sound (synthetic reproduced sound).

Next, referring to FIG. 26A, there will be described the pentagonal pyramid 52 as a speaker mounting pedestal that is used when the eleven speaker drive units 20D are supported by the multifaced mounting pedestal assembly 51 in the multifaced diaphragm assembly 11A.

As shown in FIG. 26A, the aforementioned pentagonal pyramid 52 as a speaker mounting pedestal is a vital member of the fourth embodiment. The pentagonal pyramid 52, being formed of a non-magnetic resin, has a polygonal surface 52*a* that opposes the inner surface of the regular pentagonal diaphragm segment 12 and is similar to but smaller than the diaphragm segment 12, and five outer peripheral surfaces 52*b* that extend from each edge of the polygonal surface (referred to as a pentagonal surface, hereinafter) 52*a* so as to lean against each other and are combined integrally to form a pyramid. In addition, on each of the outer peripheral surfaces 52*b* is formed a pin portion 52*b*1 so as to protrude therefrom and alongside of the pin portion 52*b*1 is formed a fit-in hole 52*b*2.

There is created a slightly-concaved circular concave portion 52*a*1 that allows the yoke 21 constituting a part of the speaker drive unit 20D to be appropriately positioned and secured in the center portion of the pentagonal surface 52*a* of the pentagonal pyramid 52 as a speaker mounting pedestal. The bottom face 21*c* of the yoke 21 is adhered to the circular concave portion 52*a*1 using an adhesive applied therein in advance, as shown in FIGS. 25 and 27, and thus the speaker drive unit 20D is attached on the pentagonal surface 52*a* of the pentagonal pyramid 52 so as to face to the central portion of the inner surface of the diaphragm segment 12.

Referring back to FIG. 25, the multifaced mounting pedestal assembly 51 having twelve surfaces is obtained in the following way: the pentagonal pyramids 52 formed as described above are arranged side by side so that the outer peripheral surfaces 52*b* oppose with one another; the pin portion 52*b*1 on the outer peripheral surface 52*b* of one pentagonal pyramid 52 is fitted into the fit-in hole 52*b*2 in the outer peripheral surface 52*b* of the other pentagonal pyramid 52 thereby combining the pentagonal pyramids 52 arranged side by side; and by repeating the above, the eleven pentagonal pyramids 52 and the one pentagonal pyramid 52 for the bottom surface are formed into a nearly spherical shape. Then, one end portion of the pipe member 15 serving as a wire duct and a supporting member is secured to the one pentagonal pyramid 52 for the bottom surface, which is to oppose the pedestal 13 (FIG. 5).

By the way, in the fourth embodiment, when the outer peripheral surfaces 52*b* of the adjacent two pentagonal pyramids 52 are fitted, the fitting may be realized by any other suitable mechanism without limiting to the pin portions 52*b*1 and the fit-in holes 52*b*2, as far as the pentagonal pyramids 52 are positioned appropriately in relation to each other.

In addition, in the pentagonal pyramid 52 in the fourth embodiment, the pentagonal surface 52*a* is formed having a pentagonal shape as is the case with the diaphragm segment 12, which makes it possible to miniaturize the multifaced mounting pedestal assembly 51 when the pentagonal pyramids 52 are combined. However, the shape is not necessarily limited to the above, any polygonal pyramid having more vertexes than the diaphragm segment 12 may be used, as far as there are provided a plurality of surfaces opposing the diaphragm segment 12 after the polygonal pyramids are assembled into a nearly spherical shape.

Moreover, in the fourth embodiment, instead of the pentagonal pyramid 52 shown in FIG. 26A, a pentagonal pyramid pedestal 52A shown in 26B can be used as a speaker mounting pedestal and a plurality of the pentagonal pyramid pedestals 52A are assembled into a nearly spherical shape thereby obtaining a multifaced mounting pedestal assembly (not shown).

The aforementioned pentagonal pyramid pedestal 52A is composed of a pentagonal surface 52*a*, trapezoidal outer peripheral surfaces 52*b*, and a lower surface 52*c* formed by slashing off the apex portion of a pentagonal pyramid. The pin portion 52*b*1 and the fit-in hole 52*b*2 are formed on the outer peripheral surface 52*b*. When a plurality of the pentagonal pyramid pedestals 52A are assembled to obtain a multifaced mounting pedestal assembly, a hollow space (not shown) is formed in the inner central portion defined by the lower surfaces 52*c*. The hollow space may serve as an air path by providing a hole at the vertices of or any other appropriate portion of the pentagonal pyramid pedestal 52A.

By the way, the electroacoustic transducer 10D according to the fourth embodiment is assembled as shown in FIGS. 25 and 27. First, the constituting members such as the yoke 21, the magnet 22, the pole piece 23, the bobbin 24 having the voice coil 25 secured thereon, the first suspension 29, the spacer 30, and the second suspension 31 are assembled inside the outer peripheral surface 53*a* of the speaker housing 53, thereby obtaining the speaker drive unit 20D. After eleven speaker drive units 20A are obtained as above, the speaker drive units 20D are attached respectively on the pentagonal surface 52*a* of the eleven pentagonal pyramids 52. Then, the one pentagonal pyramid 52 to be the bottom face is united to the eleven pentagonal pyramids 52 to obtain the multifaced mounting pedestal assembly 51. Next, the pipe member 15 serving as a wire duct and a supporting member is secured to the one pentagonal plate 52.

Then, the pipe member 15 secured to the one pentagonal pyramid 52 is inserted into the through hole 13*a* of the pedestal 13 (FIG. 5) opposing the one pentagonal pyramid 52 in the multifaced mounting pedestal assembly 51; an adhesive is applied to the one end portion 24*a* of each bobbin 24 in the eleven speaker drive units 20D; and the diaphragm 11 are placed on the one end portion 24*a* of each bobbin 24 from above to adhere the one end portion 24*a* of each bobbin 24 to the convex ring portion 12*b* of each diaphragm segment 12 in the diaphragm 11. As a result, inside the multifaced (twelve-faced) diaphragm assembly 11A consisting of the eleven-faced diaphragm 11 and the pedestal 13 (FIG. 5), the multifaced (twelve-faced) mounting pedestal assembly 51 that is similar to and smaller than the multifaced (twelve-faced) diaphragm assembly 11A is housed, with the speaker drive unit 20D attached respectively on the pentagonal surface 52*a* of each pentagonal pyramid 52, thereby obtaining the electroacoustic transducer 10D according to the fourth embodiment.

By the way, FIG. 27 illustrates a specific shape of the first and the second suspension 29, 31 that support the bobbin 24 vibratably in the direction of the central axis.

When the electroacoustic transducer 10D is mass-produced, first of all, a plurality of the speaker drive units 20D are prepared and then attached respectively on the pentagonal surface 52*a* of the pentagonal pyramid (speaker mounting pedestal) 52. Then, the pentagonal pyramids 52 with the speaker drive units 20D are assembled to be the multifaced mounting pedestal assembly 51. By this procedure, production efficiency of the electroacoustic transducer 10D is improved.

The electroacoustic transducer 10D according to the fourth embodiment has substantially the same acoustic characteristic as the electroacoustic transducer 10A described in the first embodiment with reference to FIGS. 15 and 16, thereby providing an omnidirectional point source of sound, like a pulsating sphere.

Moreover, although detailed explanation is omitted here, when a plurality of the electroacoustic transducers 10D are prepared, they can be connected with the pipe members 15 in the same way as described as application examples 1, 2 referring to FIGS. 17 and 18.

(A Fifth Embodiment)

Figure 28:
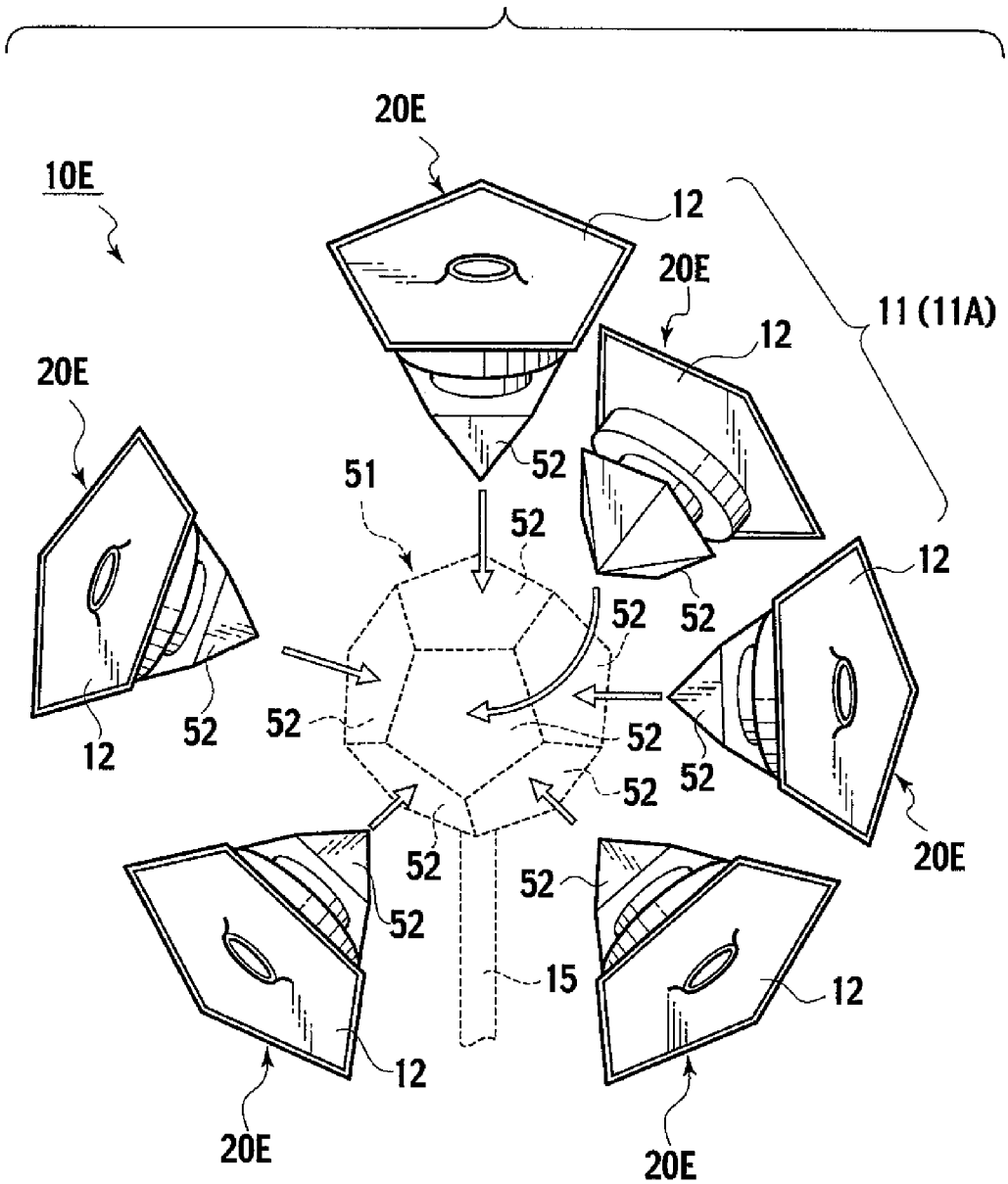
FIG. 28 is a perspective view of an electroacoustic transducer according to a fifth embodiment of the present invention.

FIG. 28 is a perspective view of an electroacoustic transducer according to a fifth embodiment.

As shown in FIG. 28, in an electroacoustic transducer 10E according to the fifth embodiment, eleven diaphragm segments 12 formed into a regular pentagon are prepared in a separate form, or without being attached with one another, which is different from the fourth embodiment. Then, after a speaker drive unit having the same configuration as the speaker drive unit according to the fourth embodiment is assembled using a speaker housing 53 as a base, each of the diaphragm segments 12 is adhered on one end portion of a bobbin 24 of the speaker drive unit, thereby obtaining eleven diaphragm-mounted speaker drive units 20E.

Then, the eleven speaker drive units 20E are attached on the pentagonal surface 52*a* of eleven pentagonal pyramids 52 that are constituting members of the multifaced mounting pedestal assembly 51 described in the fourth embodiment with reference to FIG. 26A. Also, the eleven pentagonal pyramids 52 and one pentagonal pyramid 52 for the bottom face are combined into a nearly spherical shape to obtain the multifaced mounting pedestal assembly 51.

In addition, outside of the aforementioned multifaced pedestal assembly 51, the eleven diaphragm segments 12 that are attached respectively on the eleven diaphragm-mounted speaker drive units 20E are combined together into a nearly spherical shell so as to obtain the diaphragm 11. Also, one pedestal 13 (FIG. 5) having a shape of a regular pentagon is combined to the nearly spherical shell, thereby obtaining a twelve faced diaphragm assembly 11A.

By the way, when the eleven diaphragm segments 12 are combined to obtain the diaphragm 11, edge members 14 (FIG. 25) are used to combine all the edges of the diaphragm segments 12 to be combined, as easily analogized from the explanation done with reference to FIG. 7.

Accordingly, the electroacoustic transducer 10E according to the fifth embodiment also has the same configuration and the same acoustic characteristic as the electroacoustic transducer 10D described in the fourth embodiment with reference to FIGS. 24 and 25, thereby providing an omnidirectional point source of sound. In addition, productivity for the electroacoustic transducer 10E can be increased by preparing a plurality of the diaphragm-mounted speaker drive units 20E that each are attached on the pentagonal surface 52*a* of the corresponding one of a plurality of the pentagonal pyramids 52 and by combining the plurality of the pentagonal pyramids 52 having the diaphragm-mounted speaker drive unit 20E with one another.

Moreover, although detailed explanation is omitted here, when a plurality of the electroacoustic transducers 10E according to the fifth embodiment are prepared, they can be connected with the pipe members 15 in the same way as described as the application examples 1, 2 referring to FIGS. 17 and 18.

By the way, even in the fifth embodiment, the eleven speaker drive units 20E may be attached respectively on the pentagonal surface 52*a* of the eleven pentagonal pyramid pedestals 52A constituting the multifaced mounting pedestal assembly (not shown) as described in the fourth embodiment with reference to FIG. 26B and the eleven pentagonal pyramid pedestals 52A and one pentagonal pyramid pedestal 52A to be the bottom face may be combined into a nearly spherical shape.

(A Sixth Embodiment)

Figure 29:
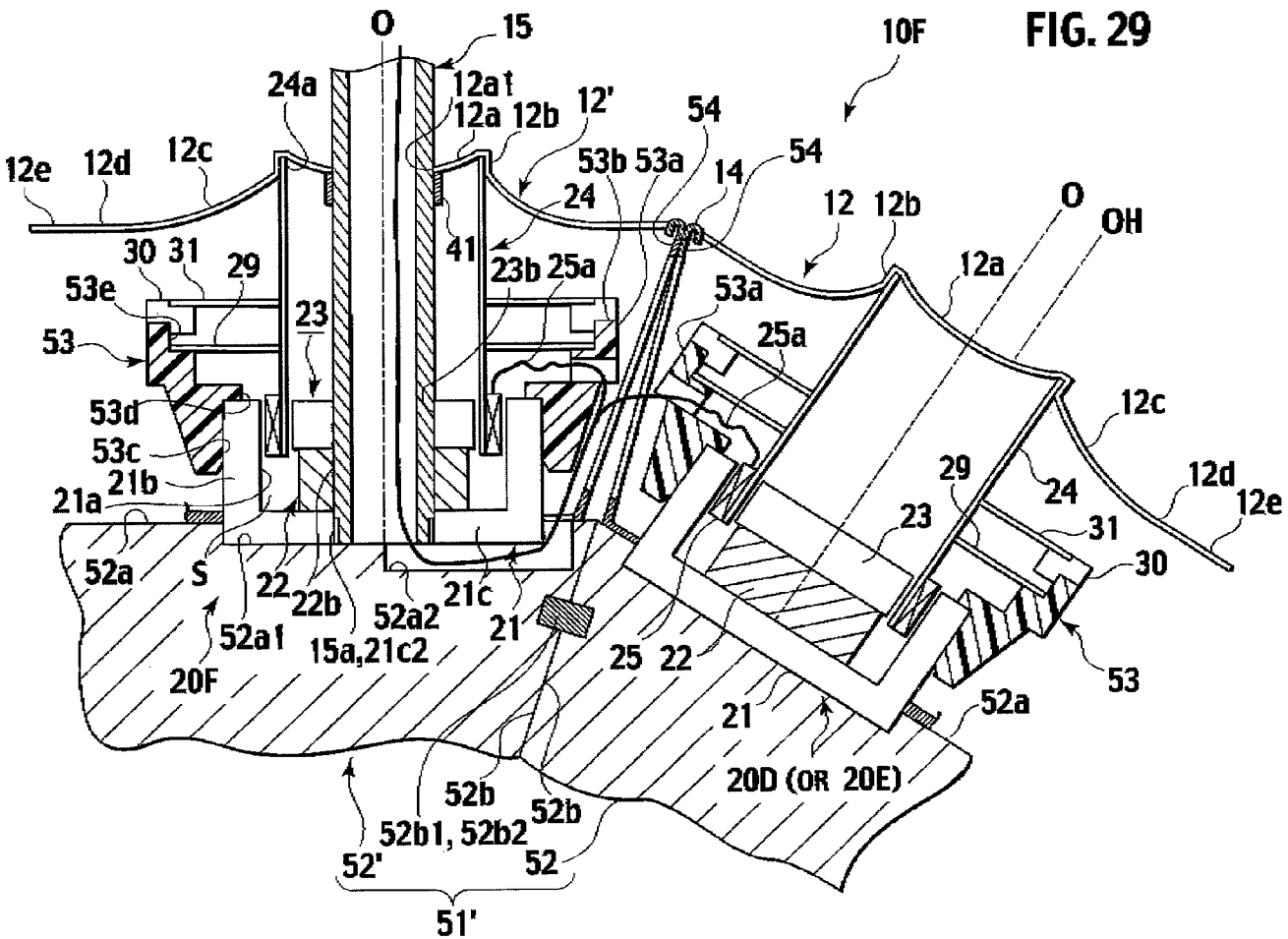
FIG. 29 is a partial cross-sectional view of an electroacoustic transducer according to a sixth embodiment of the present invention, including a partial view thereof.
Figure 30A:
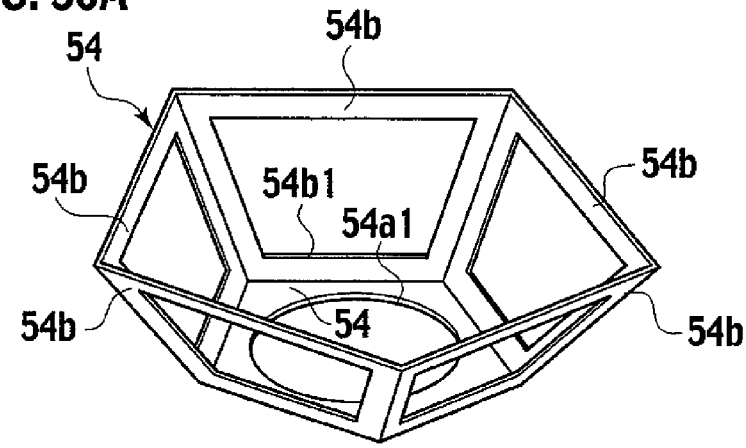
FIGS. 30A through 30C are a perspective view of a diaphragm connecting member that is used, where necessary, to connect a pentagonal pyramid to an inner edge portion of a diaphragm in the electroacoustic transducer according to the sixth embodiment of the present invention.
Figure 30B:
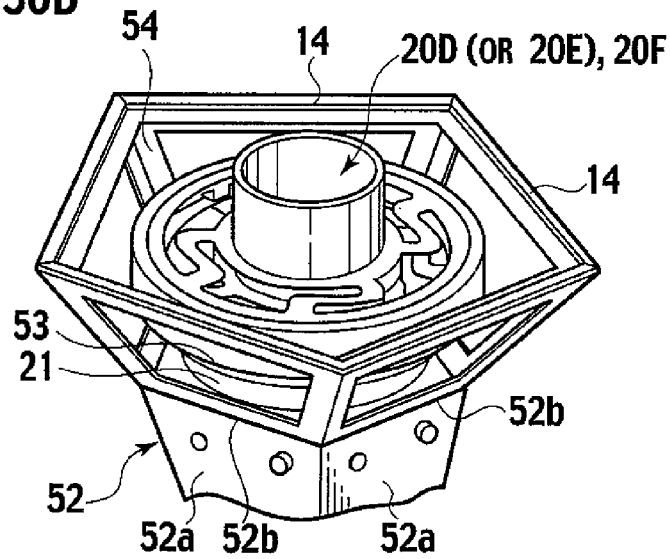
Figure 30C:
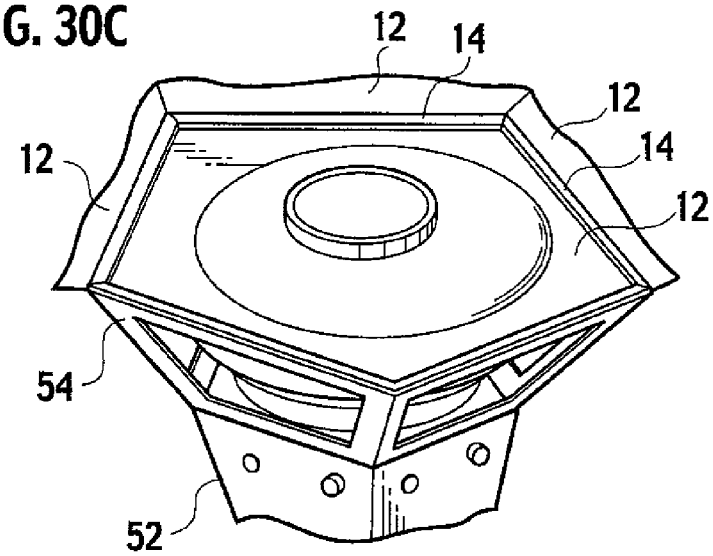

FIG. 29 is a partial cross-sectional view of an electroacoustic transducer according to a sixth embodiment of the present invention, for purposes of explanation, with a part of the lower portion thereof omitted. FIGS. 30A through 30C are a perspective view of a diaphragm connecting member that is used, where necessary, to connect a pentagonal pyramid to an inner edge portion of a diaphragm in the electroacoustic transducer according to the sixth embodiment of the present invention.

An electroacoustic transducer 10F according to the sixth embodiment of the present invention shown in FIG. 29 has the same configuration as the electroacoustic transducers 10D, 10E according to the fourth and the fifth embodiment, except a couple of portions. For the sake of simplicity, the following explanation will be centered on the different portions, with new reference marks given to new components and members, which are not used in the fourth and the fifth embodiment, while the aforementioned components and members will be explained where necessary, with like reference marks given to like components and members.

As shown in FIG. 29, in the electroacoustic transducer 10F according to the sixth embodiment of the present invention, there is prepared one pentagonal diaphragm segment 12' into which the pipe member 15 serving as a wire duct and a supporting member for the transducer 10C can be inserted, instead of the pedestal 13 (FIG. 13), in a portion to be the bottom face of the electroacoustic transducer 10F, which is different from the fourth and the fifth embodiment. As described in advance with reference to FIG. 21, the eleven diaphragm segments 12 and the one diaphragm segment 12' are combined to form a diaphragm 11' and the diaphragm 11' is assembled into a nearly spherical shell by combining the neighboring two diaphragm segments 12, 12' using a plurality of the edge portions 12*f* and the edge members 14. This is how the twelve faced diaphragm assembly 11A' is obtained.

By the way, the multifaced pentagonal diaphragm (multifaced polygonal diaphragm) 11' may be assembled either by combining the eleven diaphragm segments 12 and the one diaphragm segment 12' to be the bottom face in advance as shown in FIG. 21, or by attaching the eleven diaphragm segments 12 and the one diaphragm segment 12' to be the bottom face respectively to twelve corresponding speaker drive units 20E, 20F (described later) in advance and then by combining the twelve diaphragm segments 12, 12'.

Therefore, the electroacoustic transducer 1OF according to the sixth embodiment has the same appearance as the electroacoustic transducer 10C according to the third embodiment described in advance with reference to FIG. 20.

By the way, as shown in FIG. 29, in order to attach the pipe member 15 serving as a wire duct and a supporting member for the electroacoustic transducer 10C to the portion to be the bottom face of the electroacoustic transducer 10C, there is provided in a concave surface portion 12*a* of the one diaphragm segment 12' a through hole 12*a*1 for the pipe member to be inserted into, wherein the center of the through hole 12*a*1 coincides with the central axis O and the diameter of the through hole 12*a*1 is substantially the same as the outer diameter of the pipe member 15.

The pipe member 15 is made of non-magnetic materials such as but not limited to aluminum, resin or the like since the pipe member 15 has to be inserted through the one diaphragm segment 12' into one speaker drive unit 20F attached thereon.

In addition, a cylindrical buffer member 41 formed of felt or fabric is adhered along the inner circumference of the through hole 12*a*1 for the pipe member 15 to be inserted into, the through hole 12*a*1 being provided in the concave surface portion 12*a* of the one diaphragm segment 12'. The cylindrical buffer member 41 is vibratable in the direction of the central axis along with the diaphragm segment 12'. The cylindrical buffer member 41 serves to prevent air from leaking through a gap between the pipe member 15 and the through hole 12*a*1 from the inside of the diaphragm segment 12', when the pipe member 15 is inserted into the through hole 12*a*1.

In the electroacoustic transducer 10F according to the sixth embodiment, there are attached together concentrically the eleven speaker drive units 20D (or 20E) described in the fourth embodiment (or the fifth embodiment) so as to oppose respectively the eleven diaphragm segments 12 from inside. In addition, there is attached the one speaker drive unit 20F, which has a slightly different configuration from the eleven speaker drive units 20D (or 20E), behind the one diaphragm segment 12' so as to have the center axis in common with the diaphragm segment 12'. Here, the one diaphragm segment 12' is also vibratable by the one speaker drive unit 20F, like the other eleven diaphragm segments 12.

In addition, the eleven pentagonal pyramids (speaker mounting pedestal) 52 having the eleven speaker drive units 20D (or 20E) respectively attached thereon and the one pentagonal pyramid (speaker mounting pedestal) 52' that is formed into substantially the same shape as the pentagonal pyramid 52 and has thereon the one speaker drive unit 20F opposing the bottom face are combined into a nearly spherical shape as the twelve faced mounting pedestal assembly 51', as is the case with the fourth and fifth embodiment. The one pentagonal pyramid (speaker mounting pedestal) 52' is different from the eleven pentagonal pyramids (speaker mounting pedestal) 52 only in that the top surface 52*a* has a partially different shape in order to guide the lead wires from each speaker drive unit 20D (or 20E), 20F to the pipe member 15 serving as a wire duct and a supporting member.

When it comes to constituting members of the one speaker drive unit 20F, the yoke 21, the magnet 22, and the pole piece 23, which have been used in the speaker drive units 20D (or 20E), are partially modified in order to attach the pipe member 15 therein.

Specifically, among constituting members of the one speaker drive unit 20F, the yoke 21 has the screw hole 21*c*2 that penetrates through the bottom face 21*c* in such a way that the center axis of the screw hole 21*c*2 coincides with the central axis O of the diaphragm segment 12', the screw hole 21*c*2 allowing the screw portion 15*a* formed in one end portion of the pipe member 15 to be screwed thereinto.

In addition, the magnet 22 and the pole piece 23 have through holes 22*b*, 23*b*, respectively, that penetrate therethrough to allow the pipe member 15 to go therethrough. The through holes 22*b*, 23*b* are formed so that the center axis thereof coincides with the central axis O and the diameter thereof is substantially the same as the outer diameter of the pipe member 15.

With the above modification made, the pipe member 15 is secured to the yoke 21 as follows. First, the pipe member 15 is inserted through the through hole 12*a*1 formed in the concave surface portion 12*a* of the one diaphragm segment 12' opposing the bottom face of the electroacoustic transducer 10F. Then, the inserting end (with the screw portion 15*a*) of the pipe member 15 goes through the magnet 22 to reach the yoke 21. Next, the screw portion 15*a* of the pipe member 15 is screwed into the screw hole 21*c*2 of the yoke 21. After the pipe member 15 is secured to the yoke 21, the lead wires 25*a* from the plurality of voice coils 25 are guided through a wire groove 52*a*2 formed having a narrow width in the pentagonal surface 52*a* of the one pentagonal pyramid 52' and then led out through the pipe member 15.

By the way, even in the sixth embodiment, the twelve speaker drive units 20D (or 20E), 20F may be attached on the pentagonal surface 52*a* of the twelve pentagonal pyramid pedestals 52A described in advance in the fourth embodiment with reference to FIG. 26B.

Moreover, although the one end portion of the pipe member 15 is secured on the bottom surface 21*c* of the yoke 21 inside the one speaker drive unit 20F in the sixth embodiment, as is the case with the third embodiment, this configuration does not limit the sixth embodiment. The one end portion of the pipe member 15 can penetrate the center portion of the yoke 21 inside the one speaker drive unit 20F and be secured on the pentagonal surface 52*a* of the one pentagonal pyramid 52 (or the pentagonal surface 52 of the one pentagonal pyramid pedestal 52A).

As described above, according to the diaphragm 11' in the sixth embodiment, the one diaphragm segment 12' in addition to the eleven diaphragm segments 12 can vibrate, that is, the total of twelve diaphragm segments 12, 12' can vibrate, thereby providing a better acoustic characteristic than the diaphragm 11 in the fourth and the fifth embodiment.

By the way, although there has been described the pipe member 15 attached to the diaphragm segment 12' opposing the bottom face of the electroacoustic transducer 10F in the sixth embodiment, a plurality of the electroacoustic transducers 10F may be prepared and connected by a plurality of the pipe members 15 serving as a wire duct and a supporting member, as described as the application examples 1, 2 of the first embodiment with reference to FIGS. 17 and 18. When a plurality of the electroacoustic transducers 10F are connected, the electroacoustic transducer 10F has to be configured so as to have at least two of the one speaker drive units 20F having the one diaphragm segment 12' so that the appropriate numbers of the pipe members 15 are inserted accordingly into the yoke 21 of the one speaker drive units 20F.

In addition, in the electroacoustic transducer 10F according to the sixth embodiment of the present invention, there are provided a plurality of diaphragm connecting members 54, if needed, between the edge portion of the diaphragm segment 12 (or 12') and the pentagonal surface 52*a* of the pentagonal pyramid 52 (or 52') where each speaker drive unit 20D (or 20E) (20F) opposing each diaphragm segment 12 (or 12') is attached, as shown in FIG. 29. The diaphragm connecting member 42 is effective in that it can prevent the diaphragm segment 12 (or 12') from deforming by the self-weight thereof especially when the multifaced diaphragm assembly 11A is relatively large and when each edge member 14 in the multifaced diaphragm assembly 11A' is made of a soft material.

The diaphragm connecting member 54 is preferably made of a flexible material having higher flexibility than each diaphragm segment 12 (or 12 '), such as but not limited to polyurethane rubber, in order not to adversely affect the vibration of each diaphragm segment 12 (or 12') constituting the diaphragm 11' (FIG. 29).

Specifically, as shown in FIGS, 30A through 30C, the diaphragm connecting member 54 has a pentagonal bottom face 54*a* having a dimension corresponding substantially to the outer dimension of the pentagonal surface 52*a* of the pentagonal pyramid 52 (or 52'). Penetrating the bottom face 54*a*, a circular hole 54*a*1 is provided so as to allow the yoke 21 attached on the lower portion of the speaker housing 53 to go therethrough.

Additionally, the diaphragm connecting member 54 has five inclined surfaces 54*b* that each are inclined outward along the upward direction from the bottom face 54*a*. Each inclined surface 54*b* is connected one by one to form a pentagonal frame. Each inclined surface 54*b* also has a rectangular hole 54*b*1 that penetrates therethrough in order that the diaphragm connecting member 54 does not have an excessive rigidity.

The bottom face 54*a* of the diaphragm connecting member 54 is adhered on the pentagonal surface 52*a* of the pentagonal pyramid 52 (or 52') using an adhesive. Also, the upper end of each inclined surface 54*b* is adhered from inside to the edge portion 12*f* (FIG. 21) of the diaphragm segment 12 (or 12') and the edge member 14, the edge portion 12*f* being where the neighboring edges are combined.

By the way, although the upper end of the diaphragm connecting member 54 can be adhered entirely to the diaphragm segment 12 (or 12') in the sixth embodiment only the center portion thereof or both end portion thereof may be adhered to the diaphragm segment 12 (or 12') so that the diaphragm connecting member 54 supports partially the diaphragm segment 12 (or 12').

As described above, in the multifaced diaphragm assembly 11A' having a shape of a nearly spherical shell obtained by combining the total of the twelve diaphragm segments 12, 12', since the inner edge portion of each diaphragm segment 12, 12' is supported by each diaphragm connecting member 54, each diaphragm segment 12, 12' is prevented from deforming by its own weight, thereby providing a better acoustic characteristic.

By the way, the technical idea that the inner edge portion of each diaphragm segment 12, 12' is supported by each diaphragm connecting member 54 is applicable to the multifaced diaphragm assembly 11A (FIG. 24) obtained by combining the eleven diaphragm segments 12 into the diaphragm 11 having a nearly spherical shell in the fourth and the fifth embodiment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. An electroacoustic transducer comprising:

a multifaced diaphragm assembly which includes a diaphragm formed by combining a plurality of polygonal diaphragm segments and has a nearly spherical shell shape, and a plurality of speaker drive units, each of which includes a speaker housing, a bobbin that is supported vibratably by the speaker housing and adhered at a first end portion thereof on an inner center portion of each of the diaphragm segments, a voice coil that is attached on a second end portion of the bobbin, a yoke, and a magnet that generates a drive force in the voice coil along with the yoke, the plurality of speaker drive units being arranged inside the multifaced diaphragm assembly so as to oppose respectively the diaphragm segments, wherein the plurality of the speaker housings are combined to form a multifaced speaker housing assembly, wherein the multifaced speaker housing assembly is housed inside the multifaced diaphragm assembly, and wherein each speaker drive unit is connected via only the bobbin thereof to each diaphragm segment opposing the each speaker drive unit.

2. The electroacoustic transducer as recited in claim 1, wherein the multifaced speaker housing assembly is configured so that each of the speaker housings is combined with each other through concave-convex fitting.

3. The electroacoustic transducer as recited in claim 1, further comprising a path allowing air to pass through between the inner and the outer portion of the multifaced speaker housing assembly.

4. The electroacoustic transducer as recited in claim 1, wherein the multifaced diaphragm assembly includes as part thereof at least one polygonal pedestal having the same outer shape as the diaphragm segment thereby being formed into the nearly spherical shell shape.

5. The electroacoustic transducer as recited in claim 4, wherein the multifaced speaker housing assembly includes as part thereof at least one supporting plate having the same outer shape as the speaker housing thereby being formed into the nearly spherical shell shape, the supporting plate opposing the polygonal pedestal, wherein at least one pipe member penetrates through a through hole formed in the polygonal pedestal thereby being adhered thereon, and the pipe member is secured at one end portion thereof on the supporting plate, and wherein a wire of the speaker drive units passes through the pipe member.

6. The electroacoustic transducer as recited in claim 1, wherein the multifaced diaphragm assembly is formed into the nearly spherical shell shape only using the diaphragm, wherein at least one of the diaphragm segments of the diaphragm has in the center portion thereof a through hole, wherein at least one pipe member penetrates through the through hole of the diaphragm segment, and the pipe member is supported at one end portion thereof by the speaker drive unit opposing the diaphragm segment, and where a wire of the speaker dirve units passes through the pipe member.

7. The electroacoustic transducer as recited in claim 1, further comprising a plurality of diaphragm connecting members that connect an inner edge portion of the diaphragm segment constituting the multifaced diaphragm assembly and the speaker housing constituting the multifaced speaker housing assembly.

8. The electroacoustic transducer as recited in claim 7, wherein the diaphragm connecting member has a greater flexibility than that of the diaphragm segment.

* * * * *